US008048282B2

(12) United States Patent
Sekimoto et al.

(10) Patent No.: US 8,048,282 B2
(45) Date of Patent: Nov. 1, 2011

(54) APPARATUS AND METHOD FOR PLATING A SUBSTRATE

(75) Inventors: Masahiko Sekimoto, Tokyo (JP); Fumio Kuriyama, Tokyo (JP); Yasuhiko Endo, Tokyo (JP); Stephen Strausser, Austin, TX (US)

(73) Assignee: Ebara Corporation, Tokyo (JP)

( * ) Notice: Subject to any disclaimer, the term of this patent is extended or adjusted under 35 U.S.C. 154(b) by 906 days.

(21) Appl. No.: 12/071,353

(22) Filed: Feb. 20, 2008

(65) Prior Publication Data

US 2009/0045068 A1 Feb. 19, 2009

Related U.S. Application Data

(62) Division of application No. 10/843,557, filed on May 12, 2004, now abandoned.

(51) Int. Cl.
*C25D 5/02* (2006.01)
*C25D 17/00* (2006.01)

(52) U.S. Cl. ..... 205/133; 205/123; 204/224 R

(58) Field of Classification Search ..... 204/224 R; 205/133, 123

See application file for complete search history.

(56) References Cited

U.S. PATENT DOCUMENTS

| | | | | |
|---|---|---|---|---|
| 4,102,756 | A | 7/1978 | Castellani et al. | |
| 4,304,641 | A | 12/1981 | Grandia et al. | |
| 4,981,559 | A | 1/1991 | Sato et al. | |
| 5,421,987 | A | 6/1995 | Tzanavaras et al. | |
| 5,437,777 | A * | 8/1995 | Kishi | 204/224 R |
| 5,932,077 | A * | 8/1999 | Reynolds | 204/224 R |
| 6,001,235 | A | 12/1999 | Arken et al. | |
| 6,379,511 | B1 | 4/2002 | Fatula et al. | |
| 6,547,937 | B1 | 4/2003 | Oberlitner et al. | |
| 6,921,466 | B2 | 7/2005 | Hongo et al. | |
| 2001/0037945 | A1 * | 11/2001 | Okase et al. | 205/261 |

* cited by examiner

*Primary Examiner* — Luan Van

(74) *Attorney, Agent, or Firm* — Wenderoth, Lind & Ponack, L.L.P.

(57) ABSTRACT

A plating apparatus and method bubbles generated at the plating surfaces easily removed and the uniformity of the thickness of the plated film within the plated surface can be improved. The plating apparatus has a cassette table for loading a cassette in which a substrate having a plating surface is contained. An aligner for aligning the substrate, a rinser-dryer for rinsing and drying the substrate, and a plating unit for plating the substrate are also provided. The plating unit includes a plating vessel containing a plating solution, and a holder holds the substrate to immerse the substrate in the plating solution in the plating vessel. The plating surface is exposed to a nozzle which ejects the plating solution toward the plating surface.

11 Claims, 26 Drawing Sheets

APPARATUS AND METHOD FOR PLATING A SUBSTRATE

This is a divisional application of U.S. patent application Ser. No. 10/843,557, filed May 12, 2004 now abandoned.

BACKGROUND OF THE INVENTION

1. Field of the Invention

The present invention relates to an apparatus and method for plating a substrate, and more particularly to an apparatus and method used for plating metal films on a surface of a substrate such as a semiconductor wafer having fine interconnection grooves, holes or apertures of resist films thereon, or for forming solder bumps or protruding electrodes for electrically connecting to electrodes of semiconductor chip packages.

2. Description of the Related Art

In a TAB (Tape Automated Bonding) process or "flip-chip" process, the surface of a semiconductor chip having interconnects is formed with bumps or protruding electrodes comprised of gold, copper, solder, or nickel, or a layered structure of the above-mentioned materials, for electrically connecting with other chip package electrodes or TAB electrodes.

Such bumps can be formed by processes such as electroplating, vapor deposition, printing, and ball-bumping. Recent trends of increasing numbers in I/O terminals on semiconductor chips and smaller pitches of interconnections have lead to a wide use of electroplating, which can provide fine structure metallization and relatively stable operation.

Electroplating processes can be generally categorized in two types: a fountain type or cup type process in which a substrate such as a semiconductor wafer is plated while the surface to be plated faces downward and a plating solution flows upward to metallize the surface; and a dip type process in which the substrate is vertically placed in a plating vessel (container, cell, or the like) and the solution is supplied from the bottom to overflow from the top of the plating vessel.

FIG. 28 shows an example of a conventional dip type electroplating unit. The electroplating unit comprises: a substrate holder 10 for detachably holding a substrate W such as a semiconductor wafer; a plating vessel 16 containing a plating solution 12 in which the substrate W supported by a substrate holder 10 and an anode 14 are immersed so as to confront each other; and a power source 18 for applying plating voltage between the anode 14 and feeder layer (seed layer) formed on the surface to be plated of the substrate W to supply plating current. An overflow vessel 22 is provided beside the plating vessel 16 for receiving a plating solution 12 which has flowed over an upper edge of an overflow weir 20 of the plating vessel 16. The overflow vessel 22 and the plating vessel 16 are communicated through a circulation line 24 provided with a circulation pump 26, a thermostat unit 28, and a filter 30. Thus, the plating solution 12 driven by the circulation pump 26 is supplied to and fills the plating vessel 16, and then overflows the weir 20 to flow into the overflow vessel 22 and returns to the circulation pump 26 for circulation.

With the plating unit, and by supplying the plating solution 12 into the plating vessel 16 from the bottom portion to overflow the weir 20, arranging the substrate holder 10 in the plating solution 12 within the plating vessel 16 so as to confront the anode 14, and applying prescribed plating voltage between the anode 14 and the substrate W, a plated film is formed on the surface of the substrate W.

A plurality of paddles 34 (agitating rods) are vertically suspended from a lower surface of a paddle shaft 32, which is arranged above the plating vessel 16, horizontally between the substrate holder 10 and the anode 14, and parallel to their surfaces. The paddle are reciprocated horizontally in a direction parallel to the substrate W via the paddle shaft 32 to agitate the plating solution 12 within the plating vessel 16, so as to facilitate the formation of a plating film with uniform thickness.

Also, the substrate holder 10 used in the conventional dip type electroplating unit can detachably hold the substrate W while sealing the peripheral edge surface and the rear surface to expose the front surface to be plated. The substrate W is immersed in the plating solution 12 together with the holder for plating.

It is necessary to securely seal the peripheral portion of the substrate to prevent the plating solution from infiltrating to the rear surface of the substrate, which solution confronts the surface to be plated when the holder is immersed into the plating solution. A conventional substrate holder comprises a pair of supports (holding members) which are open- and closeable to each other, and one support is provided with a fixer ring. The substrate holder is used to hold a substrate by driving the fixer ring to rotate, while the substrate is held between the supports, to push the one support toward the other so that the a seal ring attached to the one support is pressed against the peripheral region of the substrate surface for sealing.

When the substrate is subjected to a series of steps including plating and other accompanying processes, the substrate is held by the holder and the holder having the substrate is transferred to plating or processing vessels, and the substrate is immersed into the plating solution or other processing solutions together with the holder.

SUMMARY OF THE INVENTION

The first object of this invention is to provide a plating apparatus and method in which bubbles generated at the plating surfaces are easily removed and the uniformity of the thickness of the plated film within the plated surface can be improved by controlling the flow of the plating solution within the plating vessel.

Another object of the invention is to provide a plating apparatus and method which can plate a substrate while the peripheral portion is securely sealed, which is suitable for a small number and small lot production, and can facilitate production of a compact plating apparatus.

An apparatus for plating a substrate having a plating surface to be plated in accordance with one aspect of the present invention comprises: a cassette table for loading a cassette containing therein a substrate; an aligner for aligning the substrate; a rinser-dryer for rinsing and drying the substrate; and a plating unit for plating the substrate. The plating unit comprises a plating vessel containing a plating solution, a holder for holding the substrate while being immersed in the plating solution in the plating vessel so as to expose the plating surface to the plating solution, and a nozzle for ejecting the plating solution toward the plating surface.

The nozzle may be movable parallel to the plating surface.

The nozzle may be provided between an anode placed within the plating vessel to confront the plating surface, and the nozzle may be provided between the anode and the plating surface.

The nozzle may be provided on a paddle which is movably arranged within the plating vessel for agitating the plating solution within the plating vessel.

The nozzle may be provided on a regulation plate arranged between an anode placed in the plating vessel and the plating surface.

An ejecting angle of the nozzle relative to the plating surface may be adjustable.

The nozzle may be supplied with a plating solution within the plating vessel circulated by a circulation line.

The nozzle may be provided with a flow controller for controlling a flow rate of the plating solution ejected by the nozzle.

The nozzle may comprise a nozzle assembly comprising a plurality of nozzles.

A method of plating a substrate having a plating surface to be plated in accordance with one aspect of the present invention comprises: holding the substrate with a substrate holder; immersing the holder in a plating solution contained in a plating vessel so as to expose the plating surface to the plating solution; placing a nozzle in the plating vessel to confront to the plating surface; and ejecting a plating solution from the nozzle toward the plating surface.

An apparatus for plating a substrate having a plating surface to be plated in accordance with another aspect of the present invention comprises: a plating vessel containing a plating solution; a holder for holding the substrate while exposing the plating surface to the plating solution within the plating vessel; and a nozzle provided in the plating vessel to confront to the plating surface for ejecting a plating solution toward the plating surface.

The nozzle may be movable relative to the plating surface.

The nozzle may be arranged to eject the plating solution at a substantially right angle relative to the plating surface.

The nozzle may be arranged to eject the plating solution at an oblique angle relative to the plating surface.

An apparatus for plating a substrate having a plating surface to be plated in accordance with another aspect of the present invention comprises: a plating vessel accommodating a plating solution and an anode therein and having a lateral opening; a substrate holder for holding the substrate while exposing the plating surface to the plating solution within the plating vessel and sealing the substrate to prevent infiltration of plating solution to a surface of the substrate other than the exposed plating surface; and a holder driving assembly for driving the substrate holder to a position where the plating surface covers the opening of the plating vessel.

The substrate holder may be laterally slidable.

The plating vessel may comprise a weir member for confining a reservoir surrounding the anode within the plating vessel, which can contain plating solution therein for immersing the anode.

The apparatus may further comprise an auxiliary plating solution supply system for circulating the plating solution within the reservoir chamber.

The apparatus may further comprise a rapid drain system for rapidly draining plating solution from the plating vessel.

The apparatus may further comprise a nozzle for ejecting plating solution toward the plating surface of the substrate held by the substrate holder.

The substrate holder may comprise a detachable seal unit comprising a seal ring and a cathode integrated together.

The seal unit may comprise a seal member for water-tightly sealing the opening of the plating vessel.

A method of plating a substrate having a plating surface to be plated comprises accommodating a plating solution and an anode in a plating vessel having a lateral opening; holding the substrate with a substrate holder while exposing the plating surface to the plating solution within the plating vessel and sealing the substrate to prevent infiltration of plating solution to a surface of the substrate other than the exposed plating surface; and driving the substrate holder to a position where the plating surface covers the opening of the plating vessel.

The plating vessel may comprise a weir member for confining a reservoir surrounding the anode within the plating vessel, the method comprising immersing the anode by introducing plating solution within the reservoir.

The method may further comprise rapidly draining plating solution from the plating vessel after plating is finished.

DETAILED DESCRIPTION OF THE PREFERRED EMBODIMENTS

Preferred embodiments of the present invention will be described by referring to the attached drawings.

Figure 1:
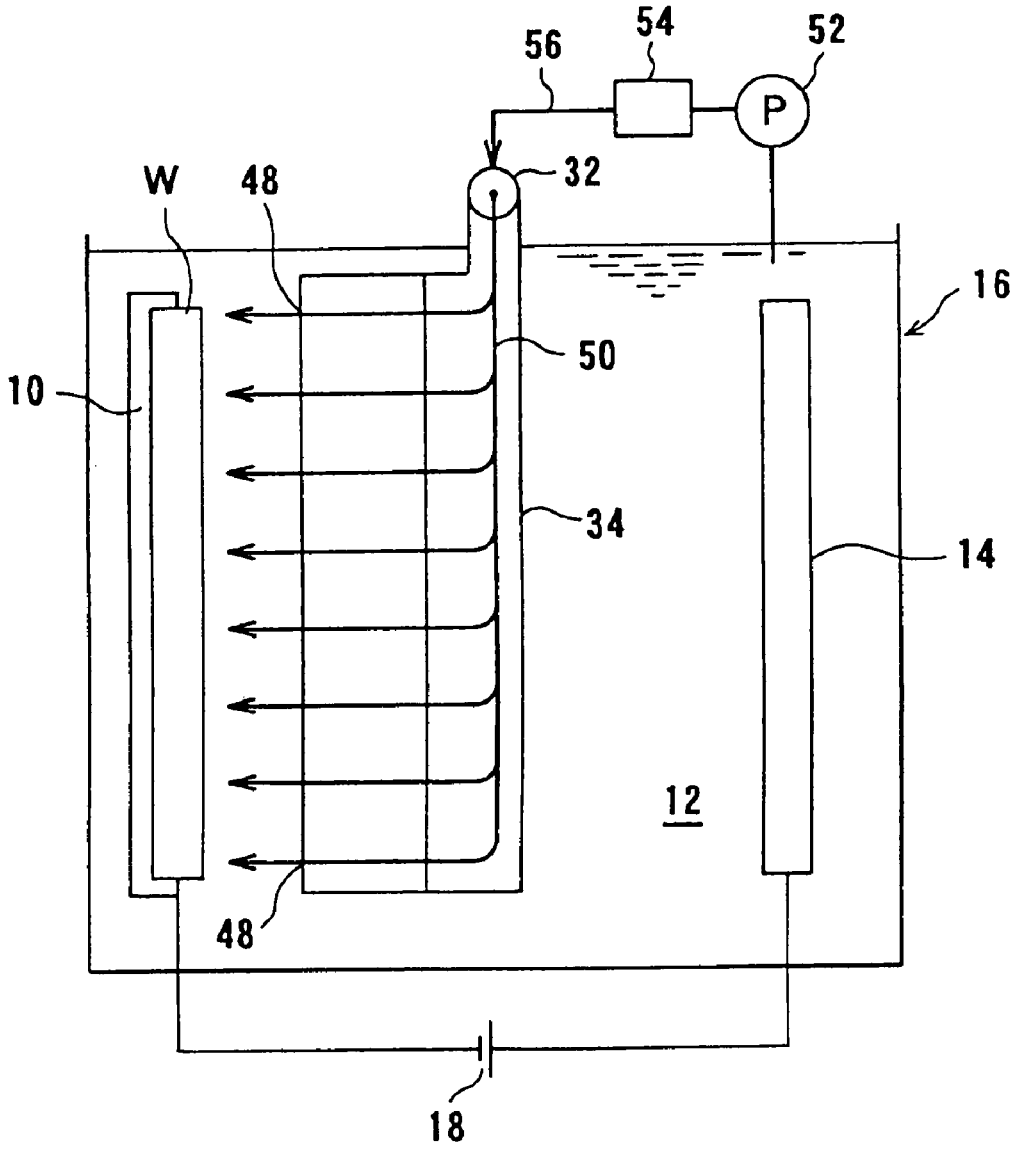
FIG. 1 is a vertical cross-sectional view of an embodiment of the present invention applied to an electroplating unit.
Figure 2:
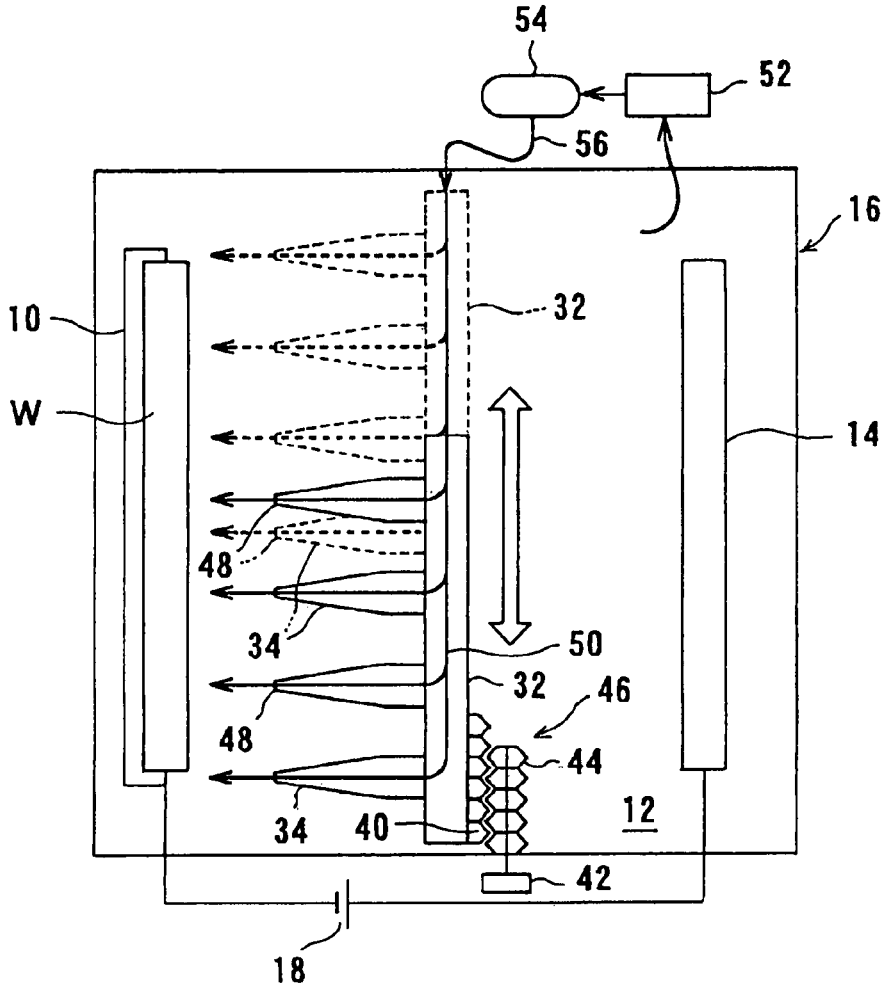
FIG. 2 is a plan view of the plating apparatus shown in FIG. 1.
Figure 3:
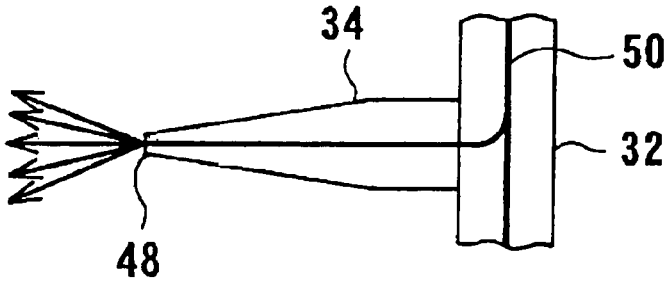
FIG. 3 is an enlarged view of another embodiment of a nozzle.

FIGS. 1 and 2 show an embodiment of the invention applied to an electroplating unit. The electroplating unit comprises: a vertically movable substrate holder 10 for detachably holding a substrate W to be plated such as a semiconductor wafer; a plating vessel or a plating cell 16 for accommodating a plating solution 12, a substrate W vertically held by the substrate holder 10, and an anode 14 (positive electrode) so that the substrate W and anode 14 are immersed in the plating solution 12 to confront each other; and a plating power source 18 for applying plating voltage between the anode 14 and a feeding layer (seed layer) formed on the surface to be plated of the substrate W to supply plating current.

A plurality of paddles (agitating rods) 34 are vertically suspended from a lower surface of a paddle puddle shaft 32, which is arranged above the plating vessel 16, horizontally located between the substrate holder 10 and the anode 14, and parallel to the surface of the substrate W. The paddle shaft 32 is provided with a drive assembly 46 comprising a rack 40 attached to the paddle shaft 32 and a worm gear 44 attached to a drive shaft of a motor 42 and engaging with the rack 40 so it can traverse the vessel 16 along with normal and reverse rotations of the motor 42. Thus, the paddles 34 also move parallel to the substrate W along with the movement of the paddle shaft 32 to agitate the plating solution 12 within the plating vessel 16. The drive assembly 46 can be constructed by any component such as a combination of a rack and a pinion, a linkage, or a linear slider.

Plating solution nozzles 48 are provided to each of the paddles 34 at the edge facing the substrate W held by the holder 10 and at mutual distances along a vertical direction to open toward the substrate W held by the holder 10 for ejecting or spurting the plating solution 12 thereto. Within the paddle shaft 32 and each of the paddles 36, plating solution passages 50 are provided to mutually communicate and reach to the plating solution nozzles 48. The plating solution passages 50 have an open end connected to a plating solution circulation line 56 having a circulation pump 52 and a flow regulator 54, and the other end of the plating solution circulation line 56 opens in the plating vessel 16. Thus, the plating solution 12 within the plating vessel 16 is pumped by the circulation pump 52 and the flow rate in the circulation line 56 is adjusted by the flow regulator 54. The plating solution 12 is then supplied to each of nozzles 48 through the line 50 to be ejected toward the substrate W held by the holder 10.

Since the nozzles 48 are provided on the paddle 34 which reciprocates parallel to the substrate W to agitate the plating solution 12 within the plating vessel 16, different members for carrying and moving the plating solution nozzles 48 are not necessary, simplifying the structure of the unit.

Although the embodiment uses a flow regulator 54 as a flow regulating device for plating solution 12, this can be dispensed with by using a positive displacement pump which may dual-purposely function as a flow regulator. Also, the embodiment employs a straight nozzle system in which the plating solution 12 is linearly ejected from the nozzle 48, but a different system can be used such as a showering system in which the solution is sprayed in a shower or as an atomized mist.

The plating process by the above described plating unit will be explained below. Initially, a predetermined amount of plating solution 12 is supplied to the plating vessel 16, and the holder 10 holding a substrate W is lowered to a predetermined position where the substrate W confronts the anode 14 readily immersed in the plating solution 12. Then, a predetermined plating voltage is applied between the anode 14 and the substrate W by the plating power source 18 for forming a plating film on the substrate surface. The drive assembly 46 drives the paddle 34 to reciprocatingly traverse the bath within the vessel 16 parallel to the substrate W to agitate the plating solution 12, and the circulation pump 52 is simultaneously driven to eject the plating solution 12 from the nozzles 48 toward the substrate W held by the holder 10.

Such processes of agitation of the plating solution 12 by the reciprocating paddles 34 and ejecting of the plating solution 12 from the nozzles 48 are synchronized with the reciprocating movement of the paddles 34 and provides an adequate amount of ions uniformly to the substrate W while directing the ejecting flow of the plating solution 12 against the substrate W from the approximately orthogonal direction, thereby facilitating thickness uniformity of the plating film within the plated area.

After the plating process is finished, the anode 14 and the substrate W are disconnected from the plating power source 18, and the holder 10 carrying the substrate W is lifted out of the plating vessel 16. After treating it with necessary processes, such as rinsing with deionized water, the plated substrate W is transferred to a next stage.

The paddles 34 may be attached to the paddle shaft 32 through a ball joint, e.g., so that the attachment angle of the paddle 34 is adjustable for enabling adjustment of the angle of the plating solution 12 ejecting from the nozzle relative to the substrate surface. Thus, the angle of the plating solution 12 to the substrate surface can be optionally adjusted in accordance with the dimension of the recesses formed on the substrate surface, e.g., to make the plating solution 12 effectively contact the recess surface.

Figure 28:
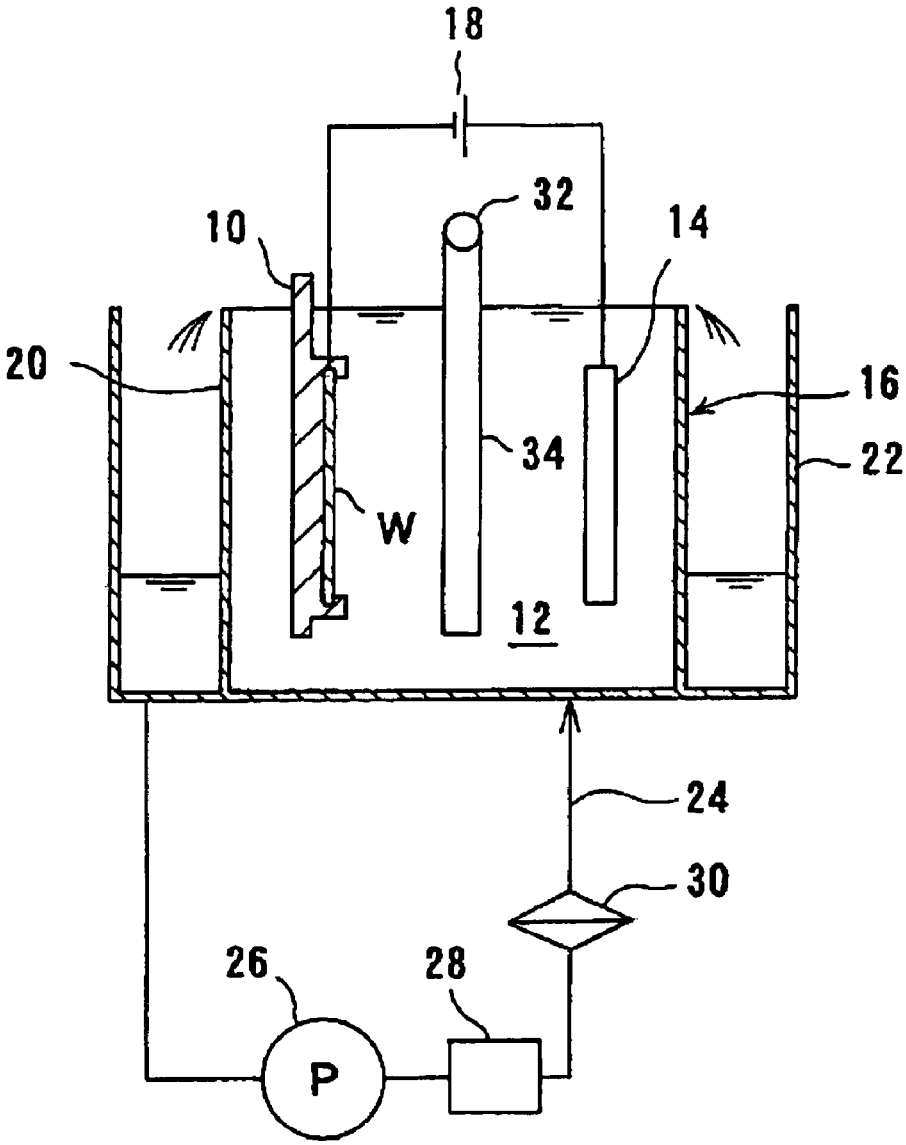
Fig. 28 PRIOR ART
FIG. 28 is a schematic view showing a conventional substrate plating unit.

The apparatus can be provided with an overflow vessel as shown in a conventional apparatus of FIG. 28 and can make the plating solution 12 having flowed into the overflow vessel be ejected from the nozzles to thereafter be circulated.

Figure 4:
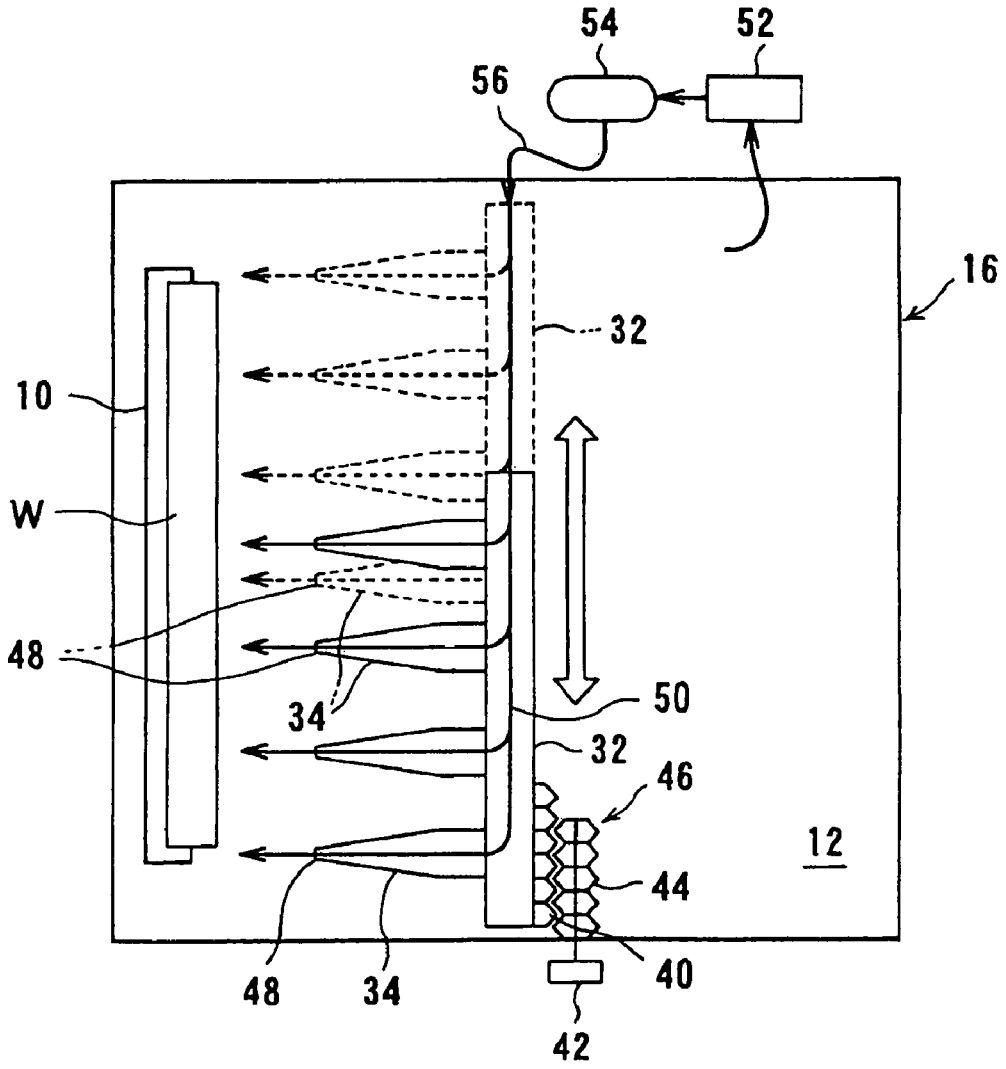
FIG. 4 is a plan view of another embodiment of the present invention applied to an electroless plating unit.

FIG. 4 shows another embodiment of the present invention applied to an electroless plating unit. This embodiment is different from the first embodiment in not having an anode 14 and a power source 18 since electroless plating does not use electricity but uses an electroless plating solution including a reducing agent as the plating solution 12 for deposition of a metal film. The remaining structure is the same as the previously described embodiment.

Figure 5:
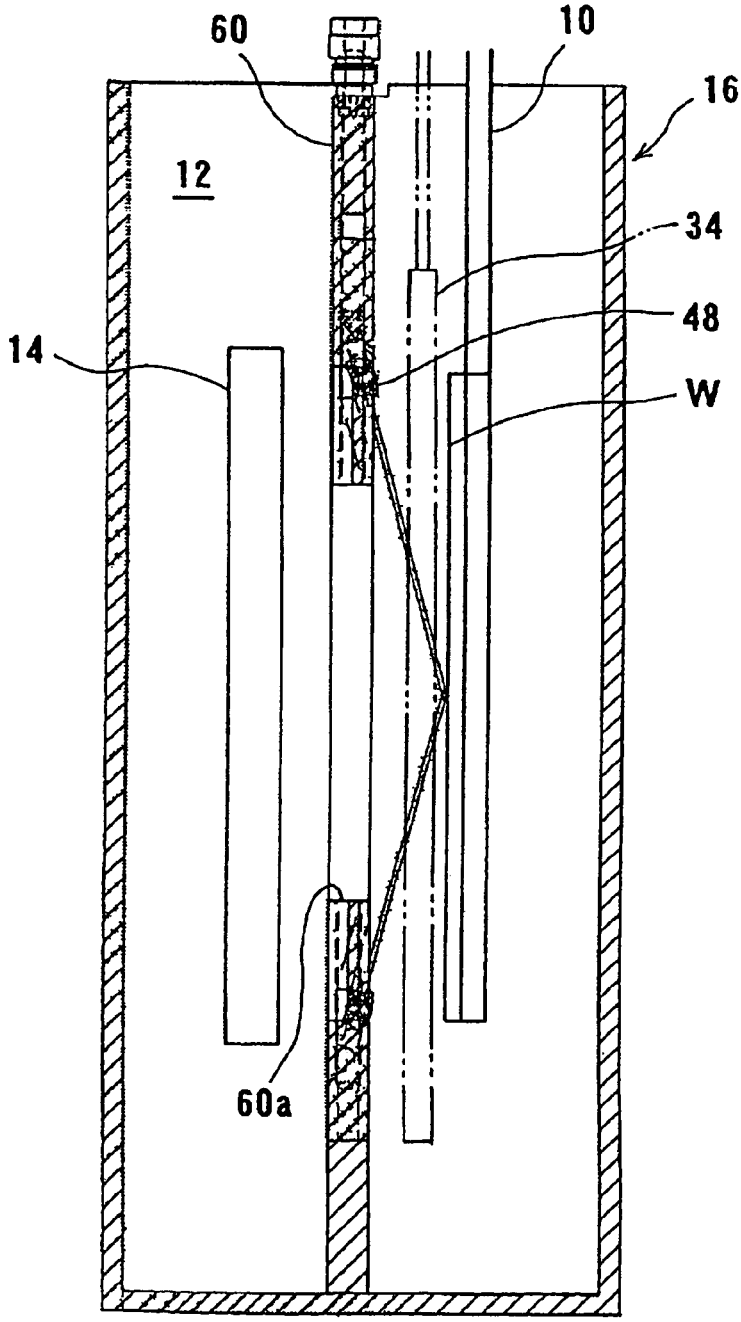
FIG. 5 is a vertical cross-sectional view of another embodiment of the present invention applied to an electroplating unit.

FIG. 5 shows another embodiment of the present invention applied to an electroplating unit. In the embodiment, a regulation plate 60 having a central aperture 60*a* of a size conforming to that of the substrate W is arranged between the substrate W held by the holder 10 and the anode 14. The regulation plate 60 having the central aperture 60*a* is widely used in the industry and functions to locally decrease the potential at the periphery of the substrate surface held by the holder 10 to thereby provide more uniform film thickness distribution. In the embodiment, four nozzles 48 are provided on the surface of the regulation plate 60 facing the holder 10 at locations proximate to the central aperture 60*a* and at catercorner locations, for example, for ejecting plating solution 12 toward the substrate W held by the holder 10. The nozzles 48 may be provided on the inner surface of the central aperture 60*a*. Plating solution passages (not shown) are provided within the regulation plate 60 which communicate with the nozzles 48. The paddles 34 can be provided between the regulation plate 60 and the holder 10.

In the embodiment, the regulation plate 60 which is generally used for the electroplating units is also used as a member for supporting nozzles 48 so that the nozzles 48 can be arranged at their positions by a relatively simple structure.

Figure 6:
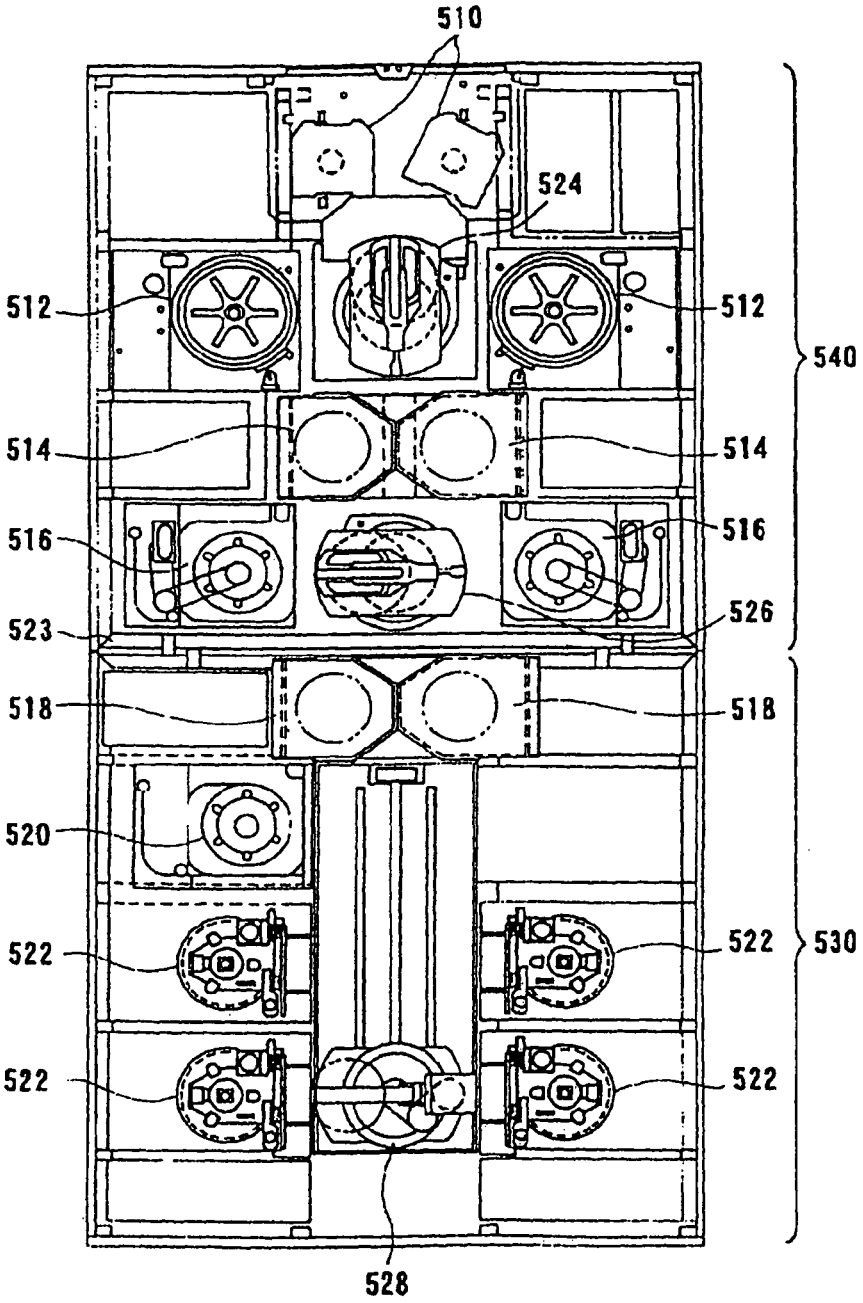
FIG. 6 is a plan view of a substrate plating apparatus having a plating unit according to an embodiment of the present invention.

FIG. 6 is a plan view of a plating apparatus comprising the above-described plating unit. The plating apparatus comprises: a loading/unloading unit 510; a pair of cleaning/drying process units 512; a pair of first substrate stages 514; a pair of bevel-etching/chemical-cleaning units 516; a pair of second substrate stages 518; a water-cleaning unit 520 capable of reversing the substrate 180 degrees; and four plating process units (electroplating units) 522. The plating apparatus further comprises: a first transfer unit 524 for transferring the substrate W between the loading/unloading unit 510, the cleaning/drying process units 512, and the first substrate stages 514; a second transfer unit 526 for transferring the substrate W between the first substrate stages 514, the bevel-etching/chemical-cleaning units 516, and the second substrate stages 518; and a third transfer unit 528 for transferring the substrate W between the second substrate stages 518, the water-cleaning unit 520, and the plating process units 522.

The interior of the plating apparatus is partitioned by a partition wall 523 into a plating space 530 and a clean space 540, and these spaces 530, 540 are capable of being independently air-supplied and exhausted. The partition wall 523 is provided with an open/closeable shutter (not shown). The pressure within the clean space 540 is conditioned lower than the atmospheric pressure and higher than the plating space 530 pressure so that the air within the clean space 540 does not flow out of the plating apparatus and air within the plating space 530 does not flow into the clean space 540.

Figure 7:
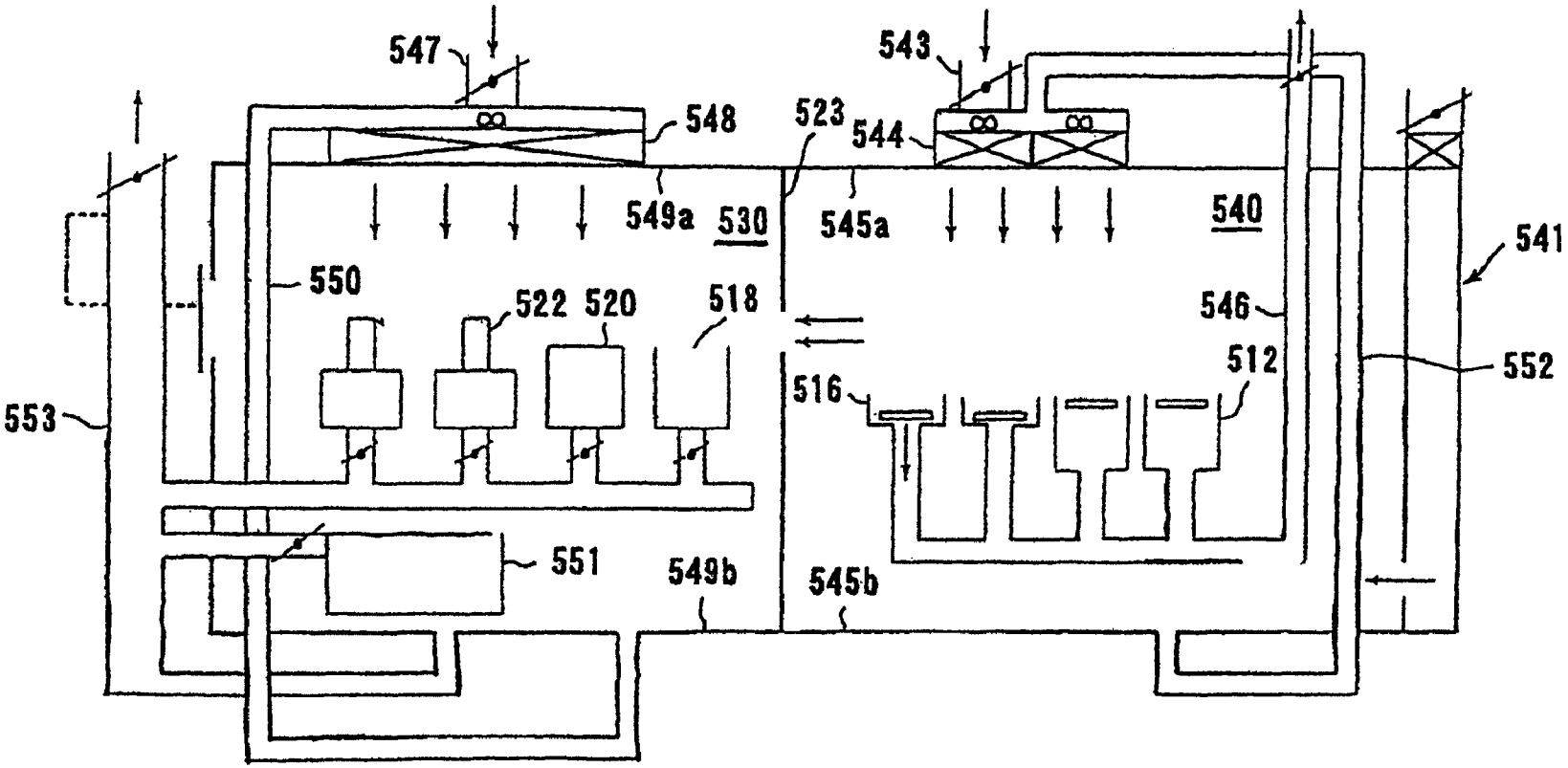
FIG. 7 is a schematic view showing airflow within the substrate plating apparatus of FIG. 6.

FIG. 7 shows air flows within the substrate plating apparatus. As shown in FIG. 7, fresh air is introduced from the exterior through a duct 543, forced through high-performance filters 544 by fans into the clean space 540, and supplied from the ceiling 545*a* as downward clean air flows around the cleaning/drying units 512 and the bevel-etching/chemical-cleaning units 516. Most of the supplied clean air is returned from a floor 545*b* through a circulation duct 552 to the ceiling 545*a*, from which the clean air is forced again through the filters 544 by the fans into the clean space 540 to be circulated within the clean space 540. A part of the clean air is exhausted from the cleaning/drying units 512 and the bevel-etching/chemical-cleaning units 516 through a duct 546 to the exterior. Thus, the clean space 540 pressure is conditioned lower than the atmospheric pressure.

Even though the plating space 530 is dirty and not a clean space due to the water-cleaning units 520 and the plating process units 522, particles are not allowed to adhere to the surfaces of the substrates W. To prevent particles from adhering to the substrates W, clean air is introduced through the duct 547, filtered by high-performance filters 544, and forced into the plating space 530 to flow downward by fans. If the entire amount of clean downward flow air should be afforded by the supply from the exterior, a large amount of air is necessarily introduced and exhausted. Thus, only partial air is exhausted to the exterior through the duct 553 for maintaining the plating space 530 pressure lower than the clean space 540, and most of the down flow air is provided by circulation air flowing through the circulation duct 550 extending from the floor 549*b*.

Thus, air having returned to the ceiling 549*a* through circulation duct 550 is forced again through the high-performance filters 544 and supplied to the plating space 530 as a clean air to be circulated. In the process, air including chemical mists or gases generated in the water-cleaning units 520, plating process units 522, transfer units and a plating solution conditioning tank 551 is exhausted through the duct 553 so that the plating space 530 is maintained at a lower pressure than the clean space 540.

Thus, when the shutter (not shown) is opened, air within these areas flows from the loading/unloading units 510, clean space 540 and to the plating space 530 in this order. The exhausted air is discharged through the ducts 553, 546 to the exterior.

Figure 8:
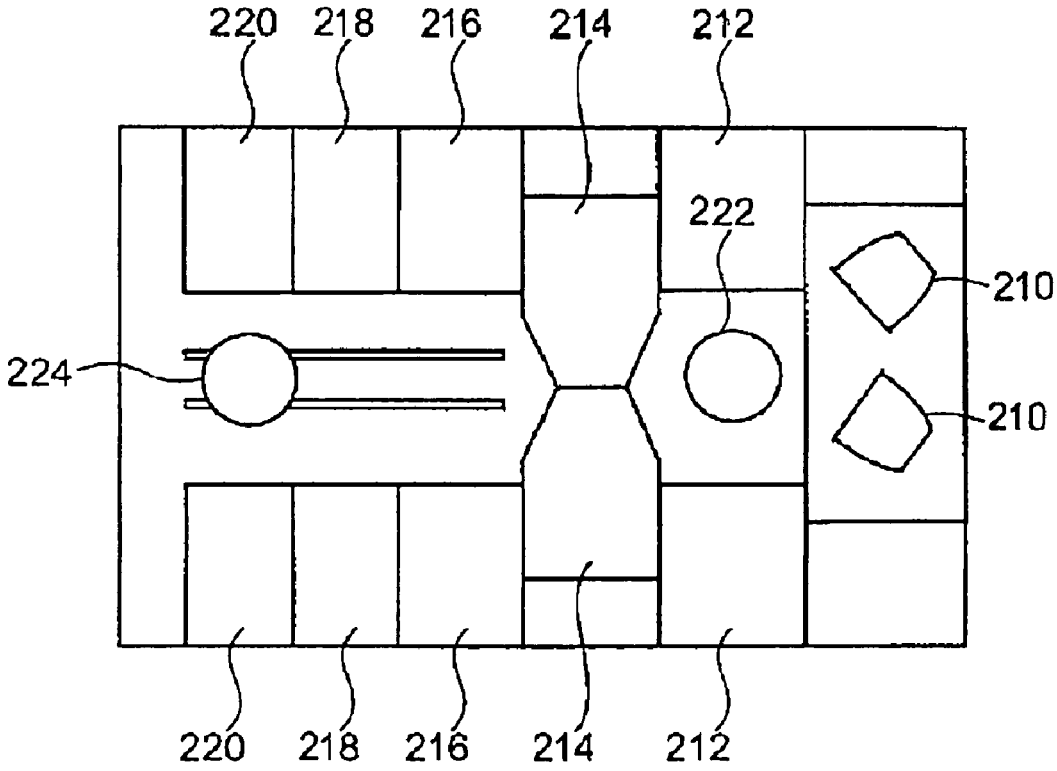
FIG. 8 is an embodiment of an interconnect formation apparatus having an electroplating unit and electrolytic etching unit according to the present invention.

An interconnect formation apparatus comprising the electroplating apparatus described above and an additional electrolytic etching apparatus is shown in FIG. 8. The interconnect formation apparatus comprises the following in pairs: loading/unloading units 210; cleaning/drying process units 212; temporary storage units 214; plating units 216; water-cleaning units 218; and etching process units 220. The interconnect formation apparatus further comprises: a first transfer assembly 222 for transferring the substrate W between the loading/unloading units 210, the cleaning/drying process units 212, and the temporary storage units 214; and a second transfer assembly 224 for transferring the substrate W between the temporary storage units 214, the plating process units 216, the water-cleaning units 218, and the etching process units 220.

Figure 9:
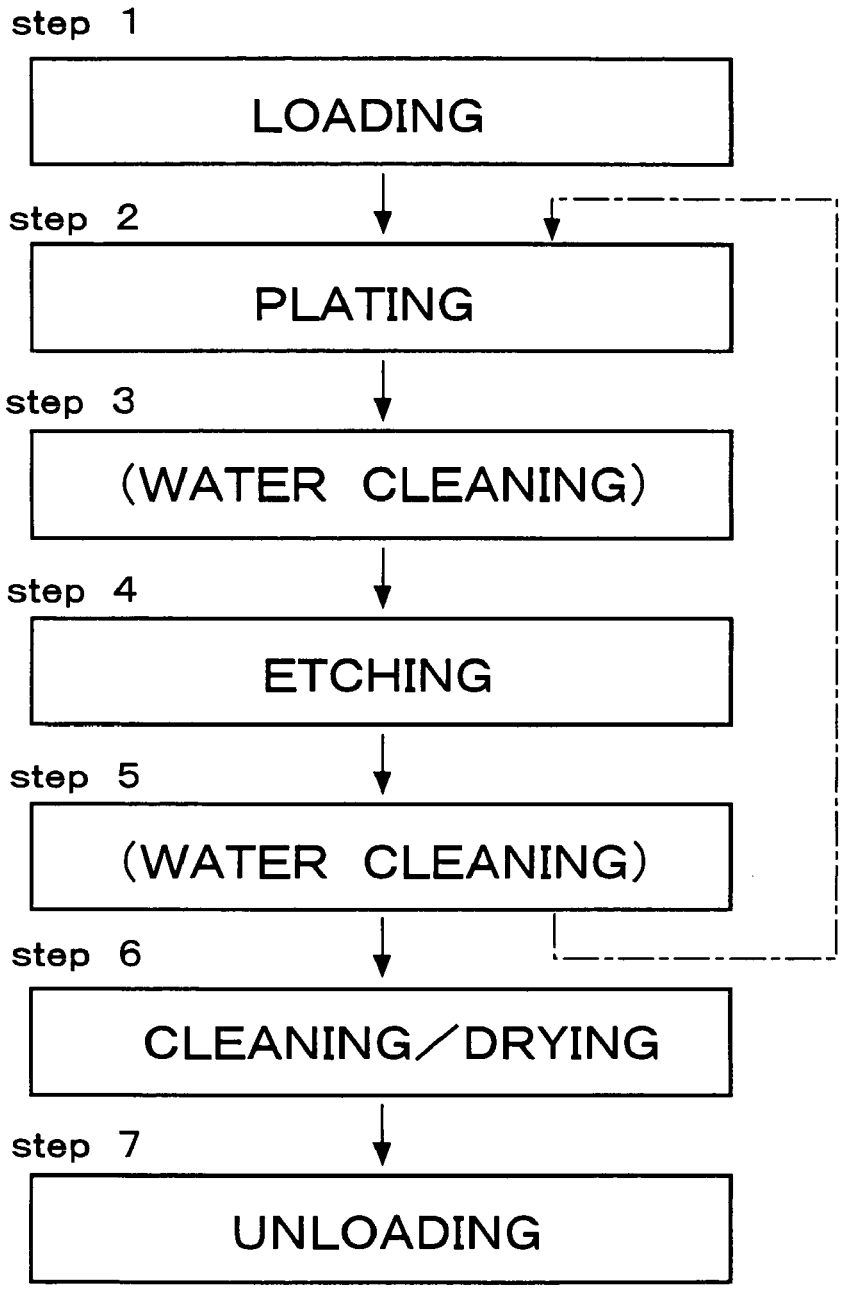
FIG. 9 is a flow chart showing a step flow in the interconnect formation apparatus of FIG. 8.

A formation process of an interconnect will be described by further referring to FIGS. 9 and 10. To start with, substrates W each formed with a seed layer on the surface are picked up from the loading/unloading unit 210 by the first transfer assembly 222 to import them to the plating process unit 216 one by one via the temporary storage unit 214 (step 1).

Figure 10:
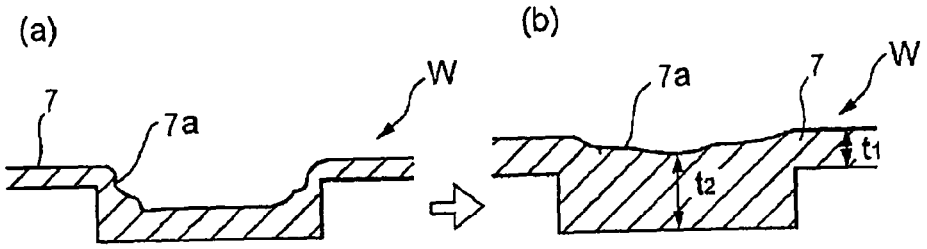
FIG. 10 is a cross-sectional view schematically showing the process of plating a substrate.

Then, the plating process unit 216 provides plating to the substrate W to form a copper layer 7 on the surface of the substrate W as shown in FIG. 10 (step 2). Plating solutions having a superior leveling ability are selected in consideration of moderating a wide recess 7*a* on the copper layer 7 as a primary concern, which results from a large recess existing on the substrate surface. Such plating solution may have a high concentration of copper sulfate and a low concentration of sulfuric acid, and one exemplified composition comprises 100~300 g/l of copper sulfate and 10~100 g/l of sulfuric acid, with an additive agent for promoting leveling ability containing poly-alkylene-imine, 4-grade ammonium salts, or cationic dyes, for example. The word "leveling ability" is used to mean a property enhancing plating growth from the bottom of recesses formed on the substrate surface.

By using the plating solution with superior leveling ability, growth from the bottom of large recesses is enhanced, as shown in FIG. 10, to obtain a copper layer of a film thickness t2 which is larger than the thickness t1 of a film formed on a flat surface. Thus, the large recess can be filled with a film having a smaller thickness t1.

The substrate W that has finished with plating is transferred to the water-cleaning unit 218 when it is necessary to be water-cleaned, and is transferred to the etching process unit 220 (step 3).

Then, the substrate W is subjected to an electrolytic etching process in the etching process unit 220 to etch the copper layer formed on the substrate surface (step 4). Etching solution used here may include additive agents for promoting etching such as pyrophoric acid, ethylene diamine, aminocarboxylic acid, EDTA, DTPA, imino-diacetic-acid, TETA, and NTA, or additive agents for suppressing etching such as 4-grade ammonium salts, a copper complex compound such as polymers, organic complexes or their derivatives, or additive agents for rendering corrosion potential of copper ignoble such as thiocarbamide or its derivatives. The base bath used here may comprise acids such as sulfuric acid, hydrochloric acid, sulfuric acid hydrogen peroxide, or hydrofluoric acid hydrogen peroxide, or alkalis such as ammonia hydrogen peroxide, but is limited thereto.

This etching process selectively etches the build-up portions of the copper layer to enhance flatness of the copper layer. Thus, the following CMP (Chemical Mechanical Planarization) process requires a smaller process rate so that CMP can be completed in a shorter period while preventing generation of so called "dishing".

Subsequently, the substrate W finished with etching is transferred to the water-cleaning unit 218 (step 5) when it is necessary so as to be water-cleaned, transferred to the cleaning/drying unit to be cleaned and dried (step 6), and returned to the cassette in the loading/unloading unit 210 by the first transfer assembly 222 (step 7).

The plating process and etching process may be repeated to selectively etch the built-up portion of the copper film for every plating process to thereby further enhance the flatness of the copper film. While this embodiment employs a continuous process of plating and etching performed within a same interconnect formation apparatus, these processes can be performed individually in independent apparatuses.

Further, in the above embodiment, the electroplating unit and electrolytic etching unit are individually provided to have the same structure and are operated using different electrolytes by applying different polarity potentials between the substrate W and the electrode (anode or cathode). However, a single apparatus can be used for both processes by exchanging the polarity so that the electroplating unit can be dual-purposely used as an electrolytic etching unit.

Figure 11:
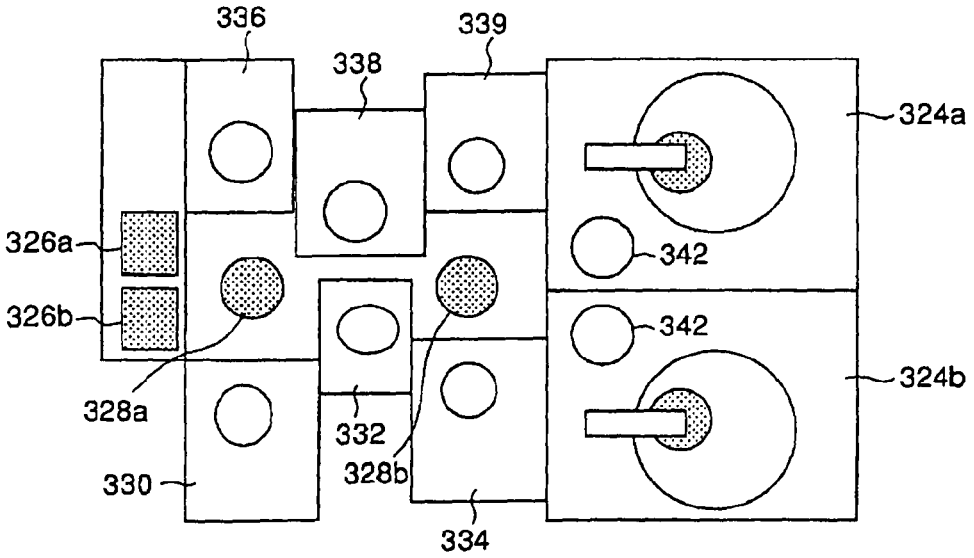
FIG. 11 is a plan view of a semiconductor manufacturing apparatus having an electroplating apparatus and an electroless plating apparatus according to an embodiment of the present invention.

Next, semiconductor device manufacturing apparatus using the electroplating unit described above will be explained by referring to FIG. 11. This apparatus is assembled on a generally rectangular space on a floor and comprises a first polishing unit 324*a* and a second polishing unit 324*b* confronting each other at one end of the space, and a pair of loading/unloading units at the other end for placing thereon substrate cassettes 326*a*, 326*b* for carrying substrates W such as semiconductor wafers. Along a virtual center line or a transfer line connecting the polishing units 324*a*, 324*b* and loading/unloading units, two transfer robots 328*a*, 328*b* are provided. On one side of the transfer line, a first plating unit (electroplating unit) 330, a copper film thickness inspection unit 332, and a pre-plating process unit 334 having a reversing machine are provided. On the other side of the transfer line, a rinsing/drying unit 336, a second (electroless) plating unit 338 for forming a protection film and a cleaning unit 339 having a sponge roller are provided. Vertically movable pushers 342 for delivering substrate W to and from the polishing units 324*a*, 324*b* are provided between the polishing units 324*a*, 324*b* and the transfer line.

Figure 12:
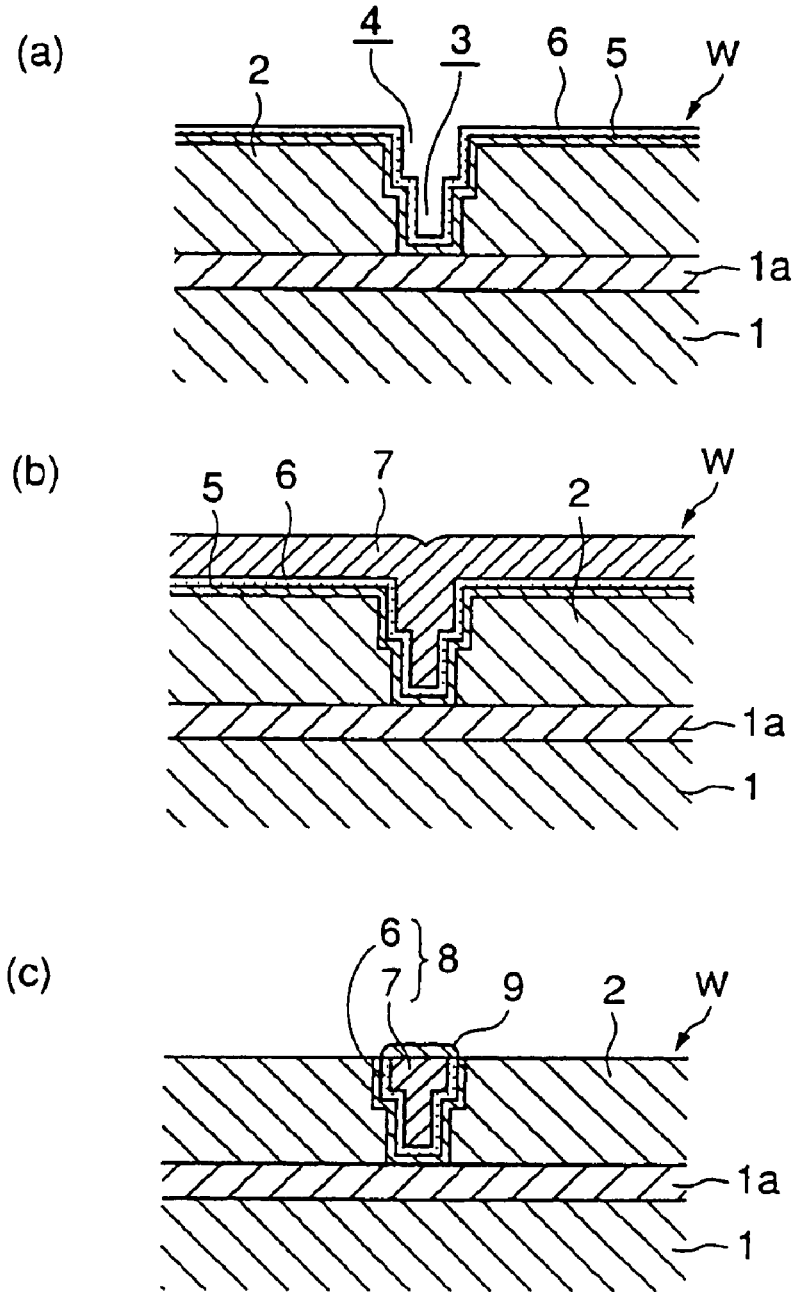
FIGS. 12(*a*) to 12(*c*) are cross-sectional views showing the process of making a semiconductor device.

An example of an interconnect forming process using the above-described semiconductor device manufacturing apparatus will be described by further referring to FIG. 12. In the first place, a semiconductor substrate W is prepared by: forming semiconductor devices on a semiconductor substrate 1; depositing a $SiO_2$ insulating film 2 on a conductive layer 1*a*; forming a contact hole 3 and a trench 4 for interconnects on the insulating film 2 by using a lithography/etching technique; forming a barrier layer 5 comprising Ta or TaN on the inner surface of the trench 4; and forming a seed layer 6 as a feeder layer for electroplating on the barrier layer by sputtering or the like.

The substrates W formed with the seed layer 6 are delivered from substrate cassettes 326*a*, 326*b* by the transfer robot 328*a* one by one and are transferred to the first plating unit 330. Here, a copper layer 7 is deposited on the surface of the substrate W to fill the trench 4. The substrate W is subjected to a hydrophilic treatment of the surface prior to plating. This process may be performed by using the plating unit 330 as an electrolytic etching unit by changing the polarity of the power supplied to etch the copper layer 7 surface as described above. After forming the copper layer 7, the substrate W is rinsed or washed by the copper plating unit 330, and may be dried if time allows.

Then, the substrate W is transferred to the film thickness inspection unit 332 to measure the thickness of the plated copper film 7, reversed if necessary, and transferred to a pusher 324 adjacent to the polishing unit 324*a* or 324*b*.

At the polishing unit 324*a* or 324*b*, the surface of the substrate W is pressed against a polishing table while supplying polishing solution to the polishing surface of the table to polish the substrate surface. Polishing is finished when a finish detection monitor has detected an endpoint. The substrate W is then returned to the pusher 324 and washed by spraying deionized water. Then, the substrate W is transferred to the cleaning unit 339 by the transfer robot 328*b* for cleaning using a sponge roller, for example. This process provides an interconnect comprising seed layer 6 and a copper layer 7 in the insulating layer 2, as shown in FIG. 12(C).

Subsequently, the substrate W is transferred to the pretreatment unit 334 in which the substrate W is subjected to application of Pd catalyst or removal of oxides from exposed surfaces, and is transferred to the second plating unit 338 to provide electroless plating. By this process, a protection film 9 comprising a Co—W—P alloy film is selectively formed by the electroless plating process on an outer surface of the interconnect which has been exposed through the polishing process to thereby protect the interconnect. The thickness of the interconnect protection film is 0.1~500 nm, preferably 1~200 nm, and more preferably 10~100 nm.

After finishing the electroless plating, the substrate W is spin-dried through high speed rotation, and is extracted from the second plating unit 338. Then, the substrate W is transferred to the cleaning unit 339 by the transfer robot 328*b* to be cleaned with the sponge roller, and is transferred to the rinsing/drying unit 336 by the transfer robot 328*a*. Then, after rinsing and drying the substrate W by the rinsing/drying unit 336, the substrate W is returned to the same position of the substrate cassette 326*a*, 326*b*.

Figure 13:
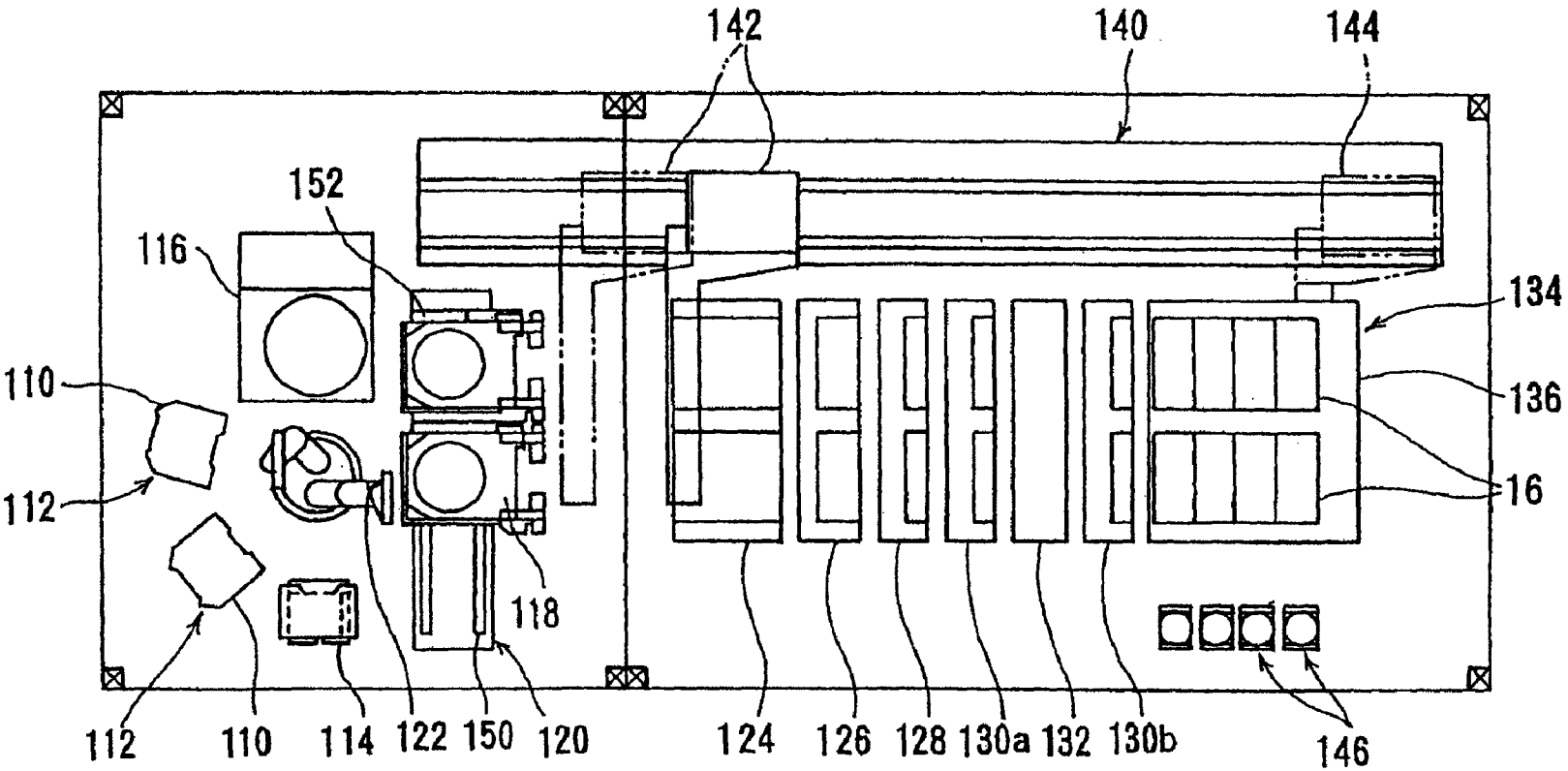
FIG. 13 is a plan view of another plating apparatus having an electroplating unit.

Another plating apparatus according to an embodiment of the present invention is shown in FIG. 13, in which the plating vessel 16 shown in FIGS. 1 and 2 is used to form bumps on the substrates W. The plating apparatus comprises: two cassette tables 112 for loading a cassette 110 containing substrates W such as semiconductor wafers; an aligner 114 for aligning the substrate W by directing an orientation flat or notch formed on the substrate W to a certain direction; and a spin-dryer 116 for drying the substrate W after plating through high speed rotation. All are arranged on the same circle. Further, a substrate mounting/demounting unit 120 is provided along one tangential line of the circle for mounting or demounting the substrate W from the holder 118 placed on the unit. At a central portion of these units, a transfer unit 122 comprising a transfer robot is provided to transfer the substrate W between these units.

Starting from the substrate mounting/demounting unit 120, the following units are provided in a linear alignment in the order: a stocker 124 for preserving or temporarily storing a substrate holder 118; a pre-wetting vessel 126 for wetting the substrate W by immersing the substrate W within deionized water to enhance hydrophilicity of the surface of the substrate W; a pre-soaking vessel 128 for removing an oxide film of a high electrical resistance formed on a seed layer on the substrate surface by etching with a chemical agent such as sulfuric acid or hydrochloric acid; a first water-cleaning vessel 130*a* for cleaning the substrate surface with deionized water; a blowing vessel 132 for dewatering the substrate W after cleaning; a second water-cleaning vessel 130*b*; and a plating unit 134. The plating unit 134 comprises a plurality of plating vessels 16 shown in FIGS. 1 and 2 within an overflow vessel 136, and each plating vessel 16 can contain a single substrate W for plating. In the following, a process of plating copper is described, while other metals or alloys such as nickel, solder, or gold can be plated in the same manner.

A substrate holder transfer unit 140 is provided on one side of those units for transferring substrate holders 118 together with the substrate W held thereon. The substrate holder transfer unit 140 comprises: a first transporter 142 for transferring substrates W between the substrate mounting/demounting unit 120 and the stocker 124; and a second transporter 144 for transferring substrates W between the stocker 124, pre-wetting vessel 126, pre-soaking vessel 128, water-cleaning vessels 130*a*, 130*b*, blowing vessel 132, and the plating unit 134. In the embodiment, the first transporter 142 is movable as far as the water-cleaning vessel 130*a*, and the movable range of the second transporter 144 is adjustable. The second transporter 144 is optional and can be dispensed with.

On the opposite side of the substrate holder transfer unit 140 relative to the overflow vessel 136, a paddle drive unit 146 is provided for driving paddles 34 (shown in FIGS. 1 and 2) arranged within each plating vessel 16 for agitating the plating solution 12.

The substrate mounting/demounting unit 120 comprises a flat mounting plate 152 laterally slidable along rails 150, which can mount thereon two substrate holders 118 horizontally juxtaposed so that, after one of the substrate holder 118 has transferred a substrate W to or from the substrate transfer unit 122, the mounting plate 152 is laterally slid to allow the other substrate holder 118 to transfer a substrate W to or from the substrate transfer unit 122.

Figure 14:
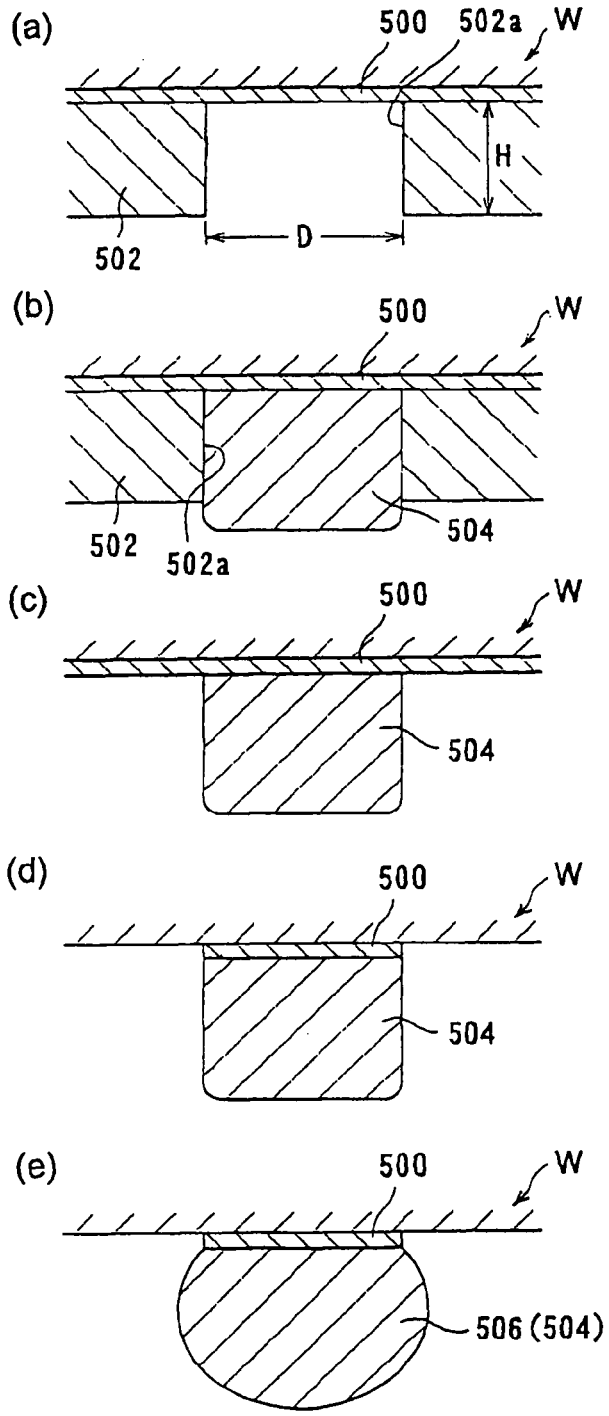
FIG. 14 is a cross-sectional view schematically showing the process of plating a bump on a substrate.

Next, sequential processes of bump plating using the above plating apparatus are described. Substrates W are prepared, as shown in FIG. 14(*a*), by depositing a seed layer 500 as a feeder on the surface of the substrate W, and, after coating a resist film 502 having a thickness H of 20~120 μm on the whole surface, forming apertures 502*a* having a diameter D of 20~200 μm. Substrates W are stored in the cassette 110 so as to face the surface to be plated upward, and the cassette 110 is then mounted on the cassette table 112.

Subsequently, the substrate transfer unit 122 takes one substrate W out of the cassette 110 mounted on the table 112 and loads it on the aligner 114 to align the orientation flat or notch to a predetermined direction. The substrate W is then transferred to the substrate mounting/demounting unit 120 by the substrate transfer unit 122.

At the substrate mounting/demounting unit 120, the transporter 142 grasps two substrate holders 118 at a time with a grasp assembly (not shown) and elevates them, transfers them to the substrate mounting/demounting unit 120, and rotates the substrate holders 118 90 degrees to a horizontal state. Then, the two substrate holders 118 are lowered and are placed concurrently on the mounting plate 152 of the substrate mounting/demounting unit 120. At this time, a cylinder (not shown) is actuated to keep the substrate holder 118 open.

In this state, a substrate W carried by the substrate transfer unit 122 is inserted and the substrate holder 118 is closed so that the substrate W is loaded. Then, the mounting plate 152 is slid laterally and the other substrate holder 118 is loaded with the substrate W and the mounting plate 152 is returned to the previous position.

Then, the substrate holder transfer unit 140 grasps two substrate holders 118 at a time with the grasp assembly of the transporter 142, and after elevating the holders 118, transfers them to the substrate mounting/demounting unit 120 and rotate them 90 degrees to a vertical state, to thereby support them with the stocker 124 in a suspended manner for temporary storage. In the substrate transfer unit 122, substrate mounting/demounting unit 120, and the transporter 142 of the substrate holder transfer unit 140, the above operations are sequentially repeated to mount the substrates W on the substrate holder 118 stored in the stocker 124 and suspend them in a certain position in the stocker 124 to temporarily store the substrate W.

Meanwhile, the other transporter 144 of the substrate holder transfer unit 140 grasps a pair of substrate holders 118 loaded with a substrate W and temporarily stored in the stocker 124 concurrently with a grasping assembly (not shown), and after elevating them, transfers them to the pre-wetting vessel 126 and lowers them to dip into a wetting liquid such as deionized water contained in the pre-wetting vessel 126 for wetting the surface to enhance hydrophilicity. The wetting liquid is not limited to deionized water as long as it can improve hydrophilicity so as to wet the substrate surface and replace the air within fine recesses or holes.

Then, a substrate holder 118 loaded with a substrate W is transferred to the pre-soaking vessel 128 in the same manner as above, so that the substrate W is dipped in the chemical agent held in the pre-soaking vessel 128 such as sulfuric acid or hydrochloric acid for etching a high electrical resistance oxide film on the seed layer 500 surface to expose a clean metal surface. Further, the holder 118 holding a substrate W is transferred to the water-cleaning vessel 130*a* in the same manner as above to clean the substrate surface with deionized water held in the water-cleaning vessel 130*a*.

After finishing water-cleaning, the substrate holder 118 is then transferred to the plating unit 134 and is supported in the plating vessel 16 in a suspended manner. The transporter 144 of the substrate holder transfer unit 140 operates the above steps repeatedly to transfer the holders 118 and sequentially suspend them in a predetermined position within the plating vessel 16. The plating vessel 16 is readily filled with a plating solution, which may be filled after finishing installation of the substrate holders 118.

After finishing installation of all the holders 118, voltage is applied between the anode 14 and the substrate W as shown in FIGS. 1 and 2, and the paddles 34 are reciprocated parallel to the substrate surface by paddle drive unit 146, and concurrently ejecting plating solution from the nozzles 48 provided on the paddles 34 to plate the surface of the substrate W. The substrate holder 118 is suspended from and secured to the upper portion of the plating vessel 16 and electricity is fed from the plating power source 18 to the seed layer 500 (see FIG. 14).

After finishing plating, the supply of plating current and plating solution, as well as paddle 34 reciprocation, is ceased and the substrate holders 118 loaded with a substrate W are held by the grasp assembly of the transporter 144 two at a time and are lifted from the plating vessel 16 and halted.

The substrate holder 118 is then transferred to the water-cleaning vessel 130*b* in the same manner as above, and immersed in the deionized water held in the water-cleaning vessel 130*b* to clean the surface. Then, the substrate holder 118 holding the substrate W is transferred to the blowing vessel 132 and water droplets on the substrate holder 118 are removed by air blow. Then, the substrate holder 118 is returned to the stocker 124 at a predetermined position to be suspended.

Meanwhile, the other transporter 142 of the substrate holder transfer unit 140 holds two of the substrate holders 118 at a time, which hold respective substrates W which have been returned to the stocker 124 after plating, and places them on the mounting plate 152 of the substrate mounting/demounting unit 120. Then, the substrate holder 118 on a central side is opened, the substrate W finished with plating is demounted by substrate transfer unit 122, is transferred to the spin-dryer 116 to be dewatered with a high speed rotation of the spin-dryer 116 after rinsing, and is returned to the cassette 110 by the substrate transfer unit 122. After returning substrate W held by one of the substrate holders 118, or simultaneously with the returning process, the mounting plate 152 is slid laterally for returning the substrate W held by the other substrate holder 118 to the cassette 110 after rinsing and spin-drying.

The mounting plate 152 is returned to an initial state, the substrate holders 118 removed of the substrate W are returned to the stocker 124, and another pair of substrate holders 118 holding the substrate W finished with plating are held by the transporter 142 and, with a grasp assembly, are placed on the mounting plate 152 of the substrate mounting/demounting unit 120 to repeat the same operation. When all of the substrates W finished with plating are demounted from the substrate holder 118, spin-dried and returned to the cassette 110, the operation is finished. Thus, the substrate W is provided with a plated film within the openings 502*a* formed on the resist film 502, as shown in FIG. 14(*b*).

The spin-dried substrates W are immersed into a solvent such as acetone held at a temperature of 50~60° C. to remove the resist films 502 formed on the substrate W as shown in FIG. 14(*c*). The substrate W is further subjected to a process for removing the exposed seed layer 500 as shown in FIG. 14(*d*). Then, the plated film is reflowed to form a bump which has been rounded by surface tension. The substrate W is annealed at a temperature higher than 100° C. to remove residual stress within the bump.

Figure 15:
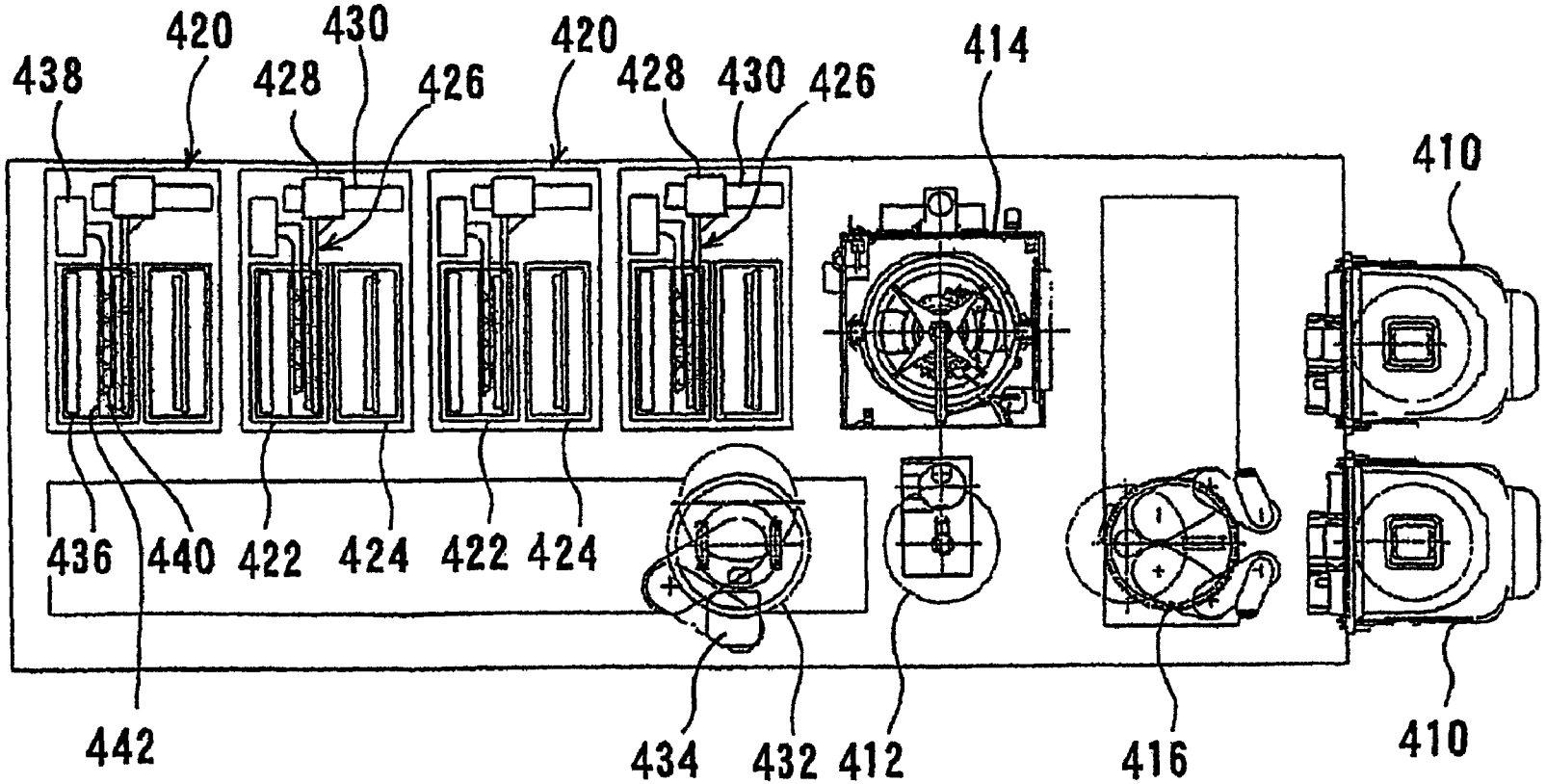
FIG. 15 is a plan view of another plating apparatus having an electroplating unit.

FIG. 15 is a plan view of another embodiment of the plating apparatus according to the present invention for forming bumps or the like. As shown in FIG. 15, the plating apparatus comprises: two cassette tables 410 for loading a cassette containing substrates W such as semiconductor wafers; an aligner 412 for aligning the substrate W by directing an orientation flat or notch formed on the substrate W to a certain direction; and a rinser-dryer 414 for rinsing and drying the substrate W after plating through high speed rotation. Further, a first transfer robot 416 is provided capable of traveling between the two cassette tables 410, aligner 412, and rinser-dryer 414 to transfer substrates W between them. The first transfer robot 416 comprises a vacuum suction type hand or a drop-in type hand to deliver substrate W in a horizontal state.

Further, this embodiment comprises four plating units 420 serially arranged. Each of these plating units 420 comprises a plating vessel 422 and water-cleaning vessel 424 contiguously arranged to each other, and a substrate holder 426 arranged above these plating vessel 422 and water-cleaning vessel 424 for detachably holding substrates W in a vertical state. The substrate holder 426 is vertically movable by a vertical drive section 428 and laterally movable by a lateral drive section 430. In front of the plating units 420, the aligner 412, the rinser-dryer 414, and a second transfer robot 432 for delivering substrates W between the substrate holder 426 of each plating unit 134 are provided. The second transfer robot 432 comprises a hand for holding a substrate W with a mechanical chuck having a reversing assembly 434 for tilting a substrate W between a horizontal state and a vertical state, so that it holds substrates W in a horizontal state when delivering between the aligner 412 and rinser-dryer 414, and in a vertical state between the substrate holder 426.

Within each plating vessel 422, an anode 436 is provided at a predetermined position to confront the substrate W held by the substrate holder 426. Each plating vessel 422 further comprises paddles 440 arranged between the substrate W and anode 436 to reciprocatingly move parallel to the substrate W to equalize the plating solution flow, and a regulation plate 442 having a central aperture of a size corresponding to the substrate W for lowering potentials about the periphery of the substrate W to equalize thickness of the plated film on the substrate W. On either one of the paddle 440 or regulation plate 442, a nozzle as shown in FIGS. 1, 2 and 5 is provided to eject plating solution toward the substrate W held by the substrate holder 426.

Here, sequential processes for plating the substrate W to form bumps by using the plating apparatus constructed as above will be described. Substrates W are prepared, as shown in FIG. 14(*a*), by depositing a seed layer 500 as a feeder on the surface of the substrate W, and, after coating a resist film 502 having a thickness H of 20~120 μm on the whole surface, forming apertures having a diameter D of 20~200 μm. Substrates W are stored in the cassette so as to face the surface to be plated upward, and the cassette is then mounted on the cassette table 410.

Subsequently, the first transfer robot 416 takes one substrate W out of the cassette mounted on the table 410 and puts it on the aligner 412 to align the orientation flat or notch to a predetermined direction. The aligned substrate W is then tilted in the reversing assembly 434 from a horizontal state to a vertical state, and is delivered to the substrate holder 426 of one of the plating units 420.

In this embodiment, transfer of the substrate W is performed at a region above the water-cleaning vessel 424. Substrate holder 426 is elevated by the vertical drive section 428, and positioned beside the water-cleaning vessel 424 by lateral drive section 430 to receive the substrate W from the second transfer robot 432 in a vertical state.

Then, the substrate holder 426 is moved to the plating vessel 422 by the lateral drive section 430. The plating vessel 422 is readily filled with a plating solution. The substrate holder 426 is lowered by the vertical drive section 428 and the substrate W held by the substrate holder 426 is immersed into the plating solution within the plating vessel 422. By applying plating voltage between the anode 436 and the substrate W, moving the paddles 440 reciprocatingly parallel to the substrate surface, and concurrently ejecting the plating solution from the nozzles 48 provided on at least one of the paddles 440 or regulation plate 442, the surface of the substrate W is plated.

When plating is finished, application of voltage, supply of plating solution and reciprocation of the paddle 440 are ceased, and the substrate holder 426 holding the substrate W is elevated and withdrawn from the plating vessel 422.

The substrate holder 426 is transferred to the water-cleaning vessel 424 by the lateral drive assembly 430 and lowered into the water-cleaning vessel 424 to be washed by deionized water. The washing process is performed by ejecting deionized water toward the substrate W from a nozzle (not shown) arranged within the water-cleaning vessel 424 while lifting the substrate W upward within the vessel 424. Another possible washing process is to rapidly pull up the substrate holder 426 through a deionized water which is readily supplied to the water-cleaning vessel 424 in advance. It is naturally possible to combine both processes.

The second transfer robot 432 receives the washed substrate W from the substrate holder 426 in a vertical state at a region above the water-cleaning vessel 424, rotates it 90 degrees to a horizontal position, and transfers it to the rinser-dryer 414 for loading there. After rinsing and dewatering by high speed rotation of the rinser-dryer 414, the substrate W is returned to the cassette loaded on the cassette table 410 to finish the operation. Thus, the substrate W is provided with a plated film 504 within the openings 502*a* formed on resist films 502, as shown in FIG. 14(*b*).

Now, another embodiment of the present invention will be described by referring to the attached drawings.

Figure 16:
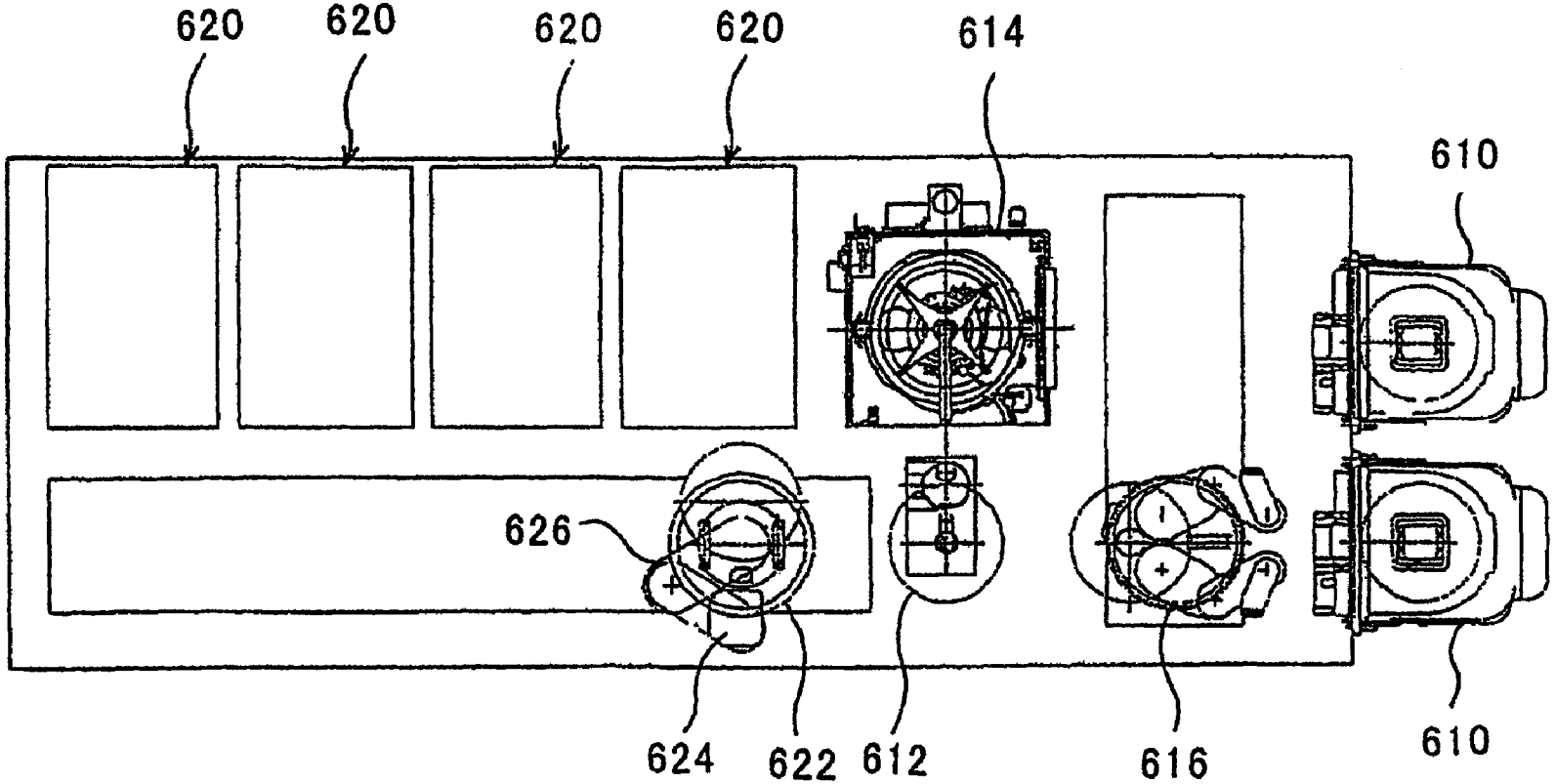
FIG. 16 is a plan view of another substrate plating apparatus having a plating unit according to an embodiment of the present invention.

As shown in FIG. 16, the plating apparatus comprises: one or plural cassette tables 610 for loading a cassette containing substrates W such as semiconductor wafers; an aligner 612 for aligning the substrate W by directing an orientation flat or notch formed on the substrate W to a certain direction; and a rinser-dryer 614 for rinsing and drying the substrate W through high speed rotation after plating. Further, a first transfer robot 616 is provided between the one or plural cassette tables 610, aligner 612, and rinser-dryer 614 and is capable of traveling and transferring substrates W between these units. The first transfer robot 616 comprises a vacuum suction type hand or a drop-in type hand to deliver substrate W in a horizontal state.

Further, the plating apparatus comprises four plating units 620 serially arranged. The number or arrangement of these plating units 620 can be optionally selected. In front of these plating units 620, the aligner 612, the rinser-dryer 614, and a second transfer robot 632 for delivering substrates W between a substrate holder 634 of each plating unit 620 are provided. The second transfer robot 632 comprises a hand 626 for holding a substrate W by a mechanical chuck and has a reversing assembly 624 for tilting a substrate W between a horizontal state and a vertical state, so that it holds substrates W in a horizontal state when delivering to the aligner 612 and rinser-dryer 614, and in a vertical state to the substrate holder 634.

As shown in FIGS. 17 to 23, each plating unit 620 comprises a plating vessel 632 mounted on a pedestal 630 and the substrate holder 634 arranged in a confronting position to the plating vessel 632. The substrate holder 634 is fixed on an upper surface of a slide plate 638 laterally slidable along rails 636 via a bracket 640.

Figure 21:
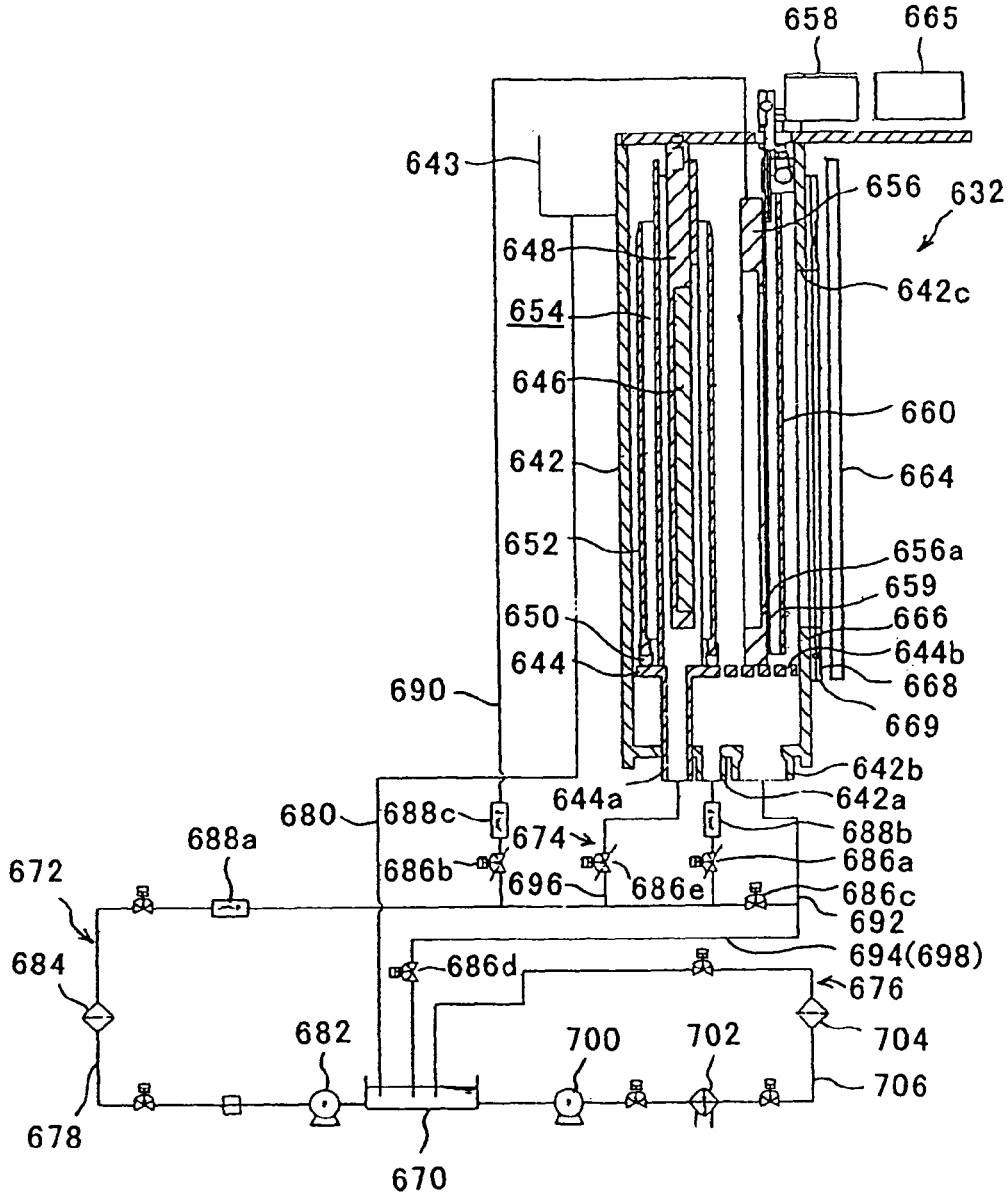
FIG. 21 is a view showing a cross section of a plating vessel and a flow diagram of a plating solution regulation supply system.

The plating vessel 632 comprises: a vessel body 642 shaped as a box opening upward and having a plating solution inlet port 642*a*, a plating solution inlet/drain port 642*b*, and a front aperture 642*c* formed on a front surface facing the substrate holder 634; and an overflow vessel 643 as shown in FIG. 21 provided on the upper portion of the vessel body 642. The vessel body 642 is partitioned by a partition plate 644 having a plating solution flow-in port 644*a* and a plating solution flow-through port 644*b*. Within the vessel body 642 and above the plating solution flow-in port 644*a*, an anode 646 is vertically arranged by being held by an anode support 648. A weir member 652 having a rectangular box shape and opening in both upward and downward directions is provided vertically movable and to surround the anode 646 when it is lowered. A seal member 650 is attached to the lower edge of the weir member 652.

The seal member 650 pressingly contacts the upper surface of the partition plate 644 when the weir member 652 is lowered to define an enclosed reservoir chamber 654 within the vessel body 642. This reservoir chamber 654 is used to reserve plating solution even when the apparatus is not plating, and the anode 636 is immersed in the reserved plating solution within the reservoir chamber 654 to prevent it from drying. This prevents a black film deposited on the surface of the anode 636 from drying, being oxidized, peeling off and sticking to the plating surface of the substrate W. The weir member 652 is lifted up when the apparatus is in operation to open the front face of the anode 646.

A regulation plate 656 having a central aperture 656*a* of a size conforming to the size of the substrate W is arranged between the weir member 652 and the front aperture 642*c* of the vessel body 642 for lowering the potentials at the periphery of the substrate surface held by the holder 634 to provide more uniform film thickness distribution. Nozzles 662 are provided on the surface of the regulation plate 656 at locations proximate to the central aperture and along a circumferential direction, for example, for ejecting plating solution toward the center of the substrate W held by the holder 634.

Paddles 660 are arranged between the weir member 652 and aperture 642*c* of the vessel body 642 to reciprocatingly move parallel to the substrate W held by the substrate holder 634 by being driven by the paddle drive motor to thereby control (or disturb) the plating solution flow between the regulation plate 656 and the substrate W held by the substrate holder 634.

Further, a nozzle head 664 is provided within the vessel body 642 and in front of the aperture 642*c*, which extends vertically and comprises nozzles at a predetermined pitch along the longitudinal direction. The nozzle head 664 is reciprocatingly movable parallel to the aperture 642*c* by a nozzle head drive motor. The nozzle head 664 is retracted at a standby position beside the substrate holder 634 while plating is in operation to avoid interference with the fore and aft movement of the substrate holder 634, and when the plating is finished, moves forward ahead of the substrate holder 634 to move reciprocatingly and parallel to the plating surface of the substrate W while ejecting cleaning liquid such as deionized water, for example, and inert gas such as $N_2$. Thus, the substrate W is showered by the ejected deionized water and inert gas and is washed away of plating solution remaining on the surfaces of the substrate W and substrate holder 634, and finally, the remaining deionized water is removed from the surface by being blown away by the inert gas.

Figure 22:
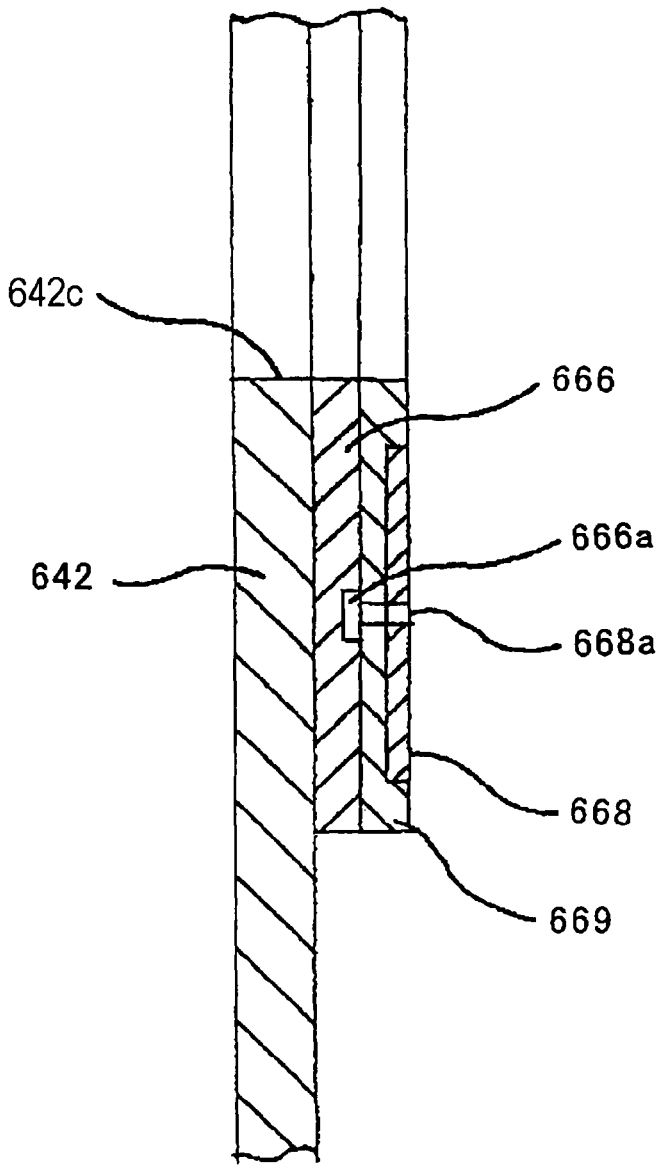
FIG. 22 is a partial enlarged view of FIG. 21.
Figure 23:
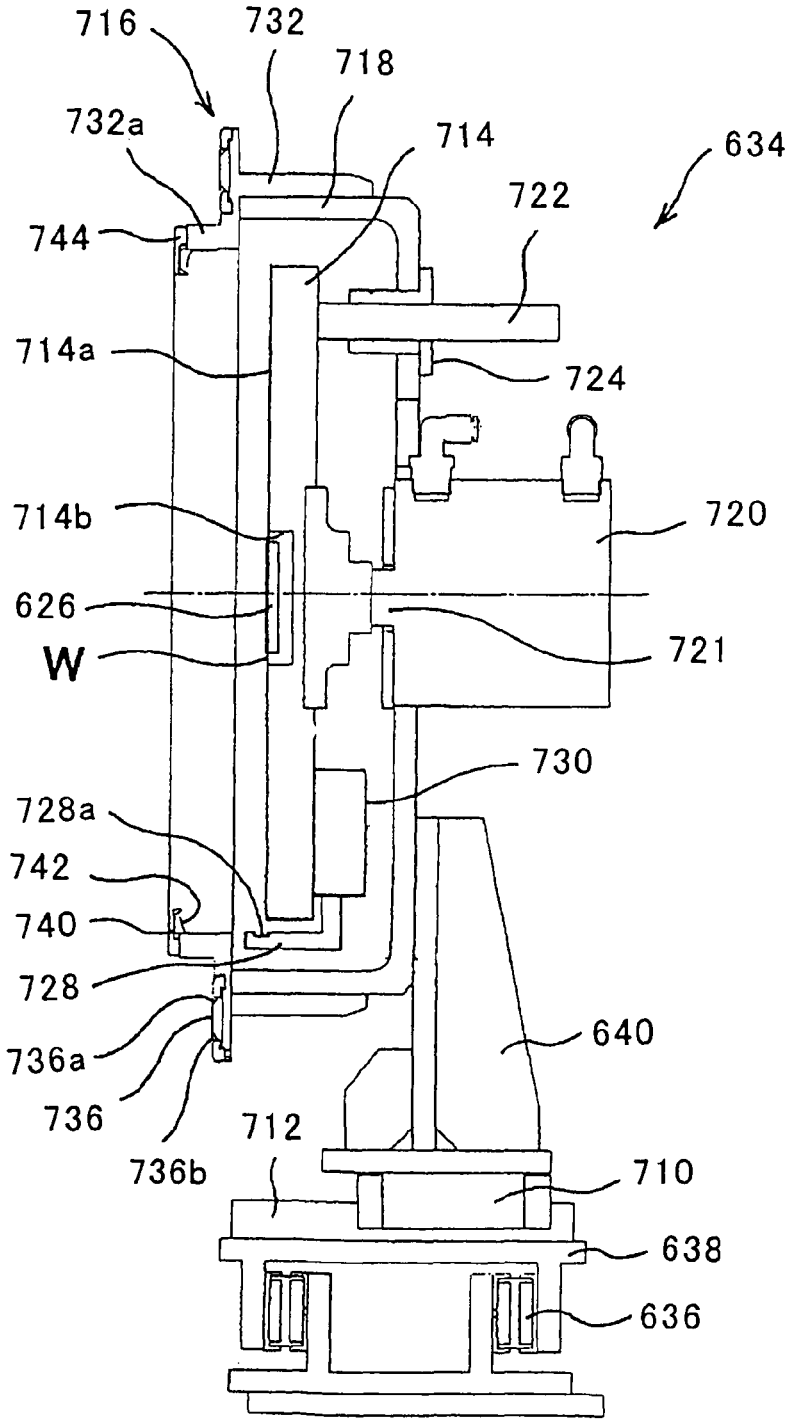
FIG. 23 is a vertical cross-sectional view showing a substrate holder.

As shown in FIG. 22 in detail, an intermediate plate 666 and a surface plate 669 are laminated or built-up at the periphery of the aperture 642*c* of the vessel body 642. The intermediate plate 666 comprises an annular communication groove 666*a*, which communicates with a vacuum source (not shown), and the surface plate 669 comprises a suction port 668*a* communicating with the communication groove 666*a* and attached with an annular seal plate 668.

The plating vessel 632 is provided with a plating solution regulation and supply system as shown in FIG. 21. The plating solution regulation and supply system comprises: a plating solution supply tank 670; a plating solution supply system 672 and an auxiliary plating solution supply system 674 for supplying and circulating the plating solution within the plating solution supply tank 670 to the plating vessel 632; and a plating solution regulation system 676 for circulating the plating solution within the plating solution supply tank 670 for regulation of a plating bath by controlling the temperature or removing impurities.

The plating solution supply system 672 comprises: a main supply line 678 extending from the plating solution supply tank 670 and connected to the plating solution inlet port 642*a* of the vessel body 642; and a return line 680 communicating the overflow vessel 643 and plating solution supply tank 670. The main supply line 678 comprises a feeder pump 682, a filter 684, a first flow controller 688*a*, a shutter valve 686*a*, and a second flow controller 688*b*. A branch line 690 is provided to bifurcate from the main supply line 678 upstream of the shutter valve 686*a* and communicates to plating solution nozzles arranged on the inside of the regulation plate 656 through a shutter valve 686*b* and a flow controller 688*c*. The plating solution supply system 672 further comprises: a rapid supply line 692 connected to the main supply line 678, comprising a shutter valve 686*c*, and connected to the plating solution inlet/drain port 642*b* of the vessel body 642; and a rapid drain line 694 directly connecting the plating solution inlet/drain port 642*b* of the vessel body 642 and the plating solution supply tank 670 and comprising a shutter valve 686*d*.

The auxiliary plating solution supply system 674 comprises an auxiliary supply line 696 bifurcating from the main supply line 678 upstream of the shutter valve 686*a* and communicates to the plating solution flow-in port 644*a* of the partition plate 644 through a shutter valve 686*e*, so that the rapid drain line 694 works dual-purposely as a return line 696.

The plating solution regulation system 676 comprises a circulation line having a circulation pump 700, a heat-exchanger 702, and a filter 704. Thus, the plating solution within the plating solution supply tank 670 is filtered by passing through the filter 704 as the circulation pump 700 is operated.

The substrate holder 634 is constructed to move back and forth along a rail 712 in accordance with the activation of a pushing cylinder 710 arranged between the slide plate 638 and the bracket 640. The substrate holder 634 comprises: a disc-shaped supporting head 714 of approximately the same size as the substrate W to be plated; and a seal unit 716 arranged in front of the supporting head 714 on a side facing the plating vessel 632 and detachably attached to the opening end of a casing 718 which surrounds the supporting head 714.

The supporting head 714 is connected to a piston rod 721 of a horizontally arranged cross drive cylinder 720 which is fixed to the casing 718, and comprises one or more guiding rods 722 connected thereto at positions along a circumferential line. These guiding rods 722 are supported by a slide bearing 724 provided on the casing 718 so as to be movable in a cross direction to the supporting head 714. Thus, the supporting head 714 is moved back and forth while being guided by the guiding rods 722.

One side of the supporting head 714 facing the plating vessel 632 comprises a flat surface 714*a* which is formed with a recess 714*b* for receiving a hand 626 of the transfer robot 622, which extends horizontally and employs vacuum chucking for holding a substrate W, for example. A plurality of holder pins 728 are arranged at locations to surround the periphery of the supporting head 714, whose tip ends protrude from the flat surface 714*a* toward the plating vessel 632 and horizontally extend rearward. The inner surface of the holder pin 728 protruding from the flat surface 714*a* is provided with a recess 714*b* for receiving the outer peripheral edge of the substrate W so as to temporarily position the substrate W while preventing displacement. The proximal end of the holder pin 728 is connected to a temporary positioning cylinder 730 provided on the rear surface of the supporting head 714 so that the temporary positioning cylinder 730 drives the holder pin 728 to move along a radial direction of the supporting head 714.

Thus, the transfer robot 622 holds the substrate W with the vacuum chucking type hand 626 and transfers it to the front surface of the supporting head 714. Then, the robot moves the hand 626 toward the supporting head 714 and locates it within the recess 714*b* close to the flat surface 714. The holder pins 728 are moved radially inside the supporting head 714 so that the peripheral edge of the substrate W is received in the recess 714*b*. The hand 626 is extracted so that the substrate W is held in front of the supporting head 714 by the holder pins 728.

The seal unit 716 comprises a generally cylindrical support member 732, which can be attached or detached to the opening of the casing 718 by using, for example, a clamp type fastener 734 (shown in FIG. 19) with a single manipulative action. As is described below, by using the seal unit 716, in which a seal ring 740, a cathode 742, and, additionally, a seal member 736 are integrally incorporated, expendable items such as seal ring 740 or seal member 736 can be easily and rapidly exchanged together with the cathode 742. Instead of using the clamp type fastener 734, the seal unit 716 can be attached/detached by using a plunger, for example, to exchange the seal ring 740 or seal member 736 more easily.

The annular seal member 736 is provided on the front surface of the support member 732 facing the plating vessel 632, and at a position opposite to the seal plate 668 provided on the surface plate 669. The seal member 736 is formed with a pair of projections 736*a*, 736*b* at the inner and outer edges. When the supporting head 714 moves toward the plating vessel 632, these projections 736*a*, 736*b* abut with the seal plate 668 so that the space defined by the projections 736*a*, 736*b* communicates with the suction port 668*a*. Thus, by vacuuming the space through the suction port 668*a*, the aperture 642*c* of the vessel body 642 is water-tightly sealed so as to block the aperture 642*c* with the substrate holder 634.

The support member 732 of the seal unit 716 comprises a cylindrical portion of a size through which the supporting head 714 holding the substrate W can pass, and on which the annular seal ring 740 and cathode electrodes 742 are integrally attached. That is, the seal ring 740 is pressed against the periphery of the substrate W, which is temporarily held by the supporting head 714, so as to seal the region. The seal ring 740 is fixed by being supported from both sides of the outer periphery with the front surface of the support member 732 facing the plating vessel 632 and a stopper ring projecting inside the cylindrical portion. The inner edge of the seal ring 740 is formed to cuspidally project toward the supporting head 714. On the other hand, the cathode electrodes 742 are elastically pressed against the periphery of the substrate W which is temporarily held by the supporting head 714, thereby allowing to feed electricity to the seed layer 500 formed on the surface of the substrate W. The cathode electrodes 742 are located at circumferentially spaced positions at a predetermined pitch, and the edge facing the plating vessel 632 is circularly curved toward the inside of the support member 732, and the curved portions are covered by the seal ring 740.

With such arrangement, when the supporting head 714 temporarily holding the substrate W moves toward the plating vessel 632, the seed layer 800 formed on the surface of the substrate W contacts with the cathode electrodes 742 at the periphery of the substrate W, and further progress of the supporting head 714 makes the cathode electrodes 742 bend to secure the contact as well as the periphery of the substrate W be pressed toward the seal ring 740 to provide a water-tight seal. At this time, the substrate W is in close contact with the flat surface 714*a* of the supporting head 714 to be fixed thereto. The cathode electrodes 742 are located outside the seal formed by the seal ring 740 so as to prevent the cathode electrodes 742 from contacting the plating solution.

Figure 24:
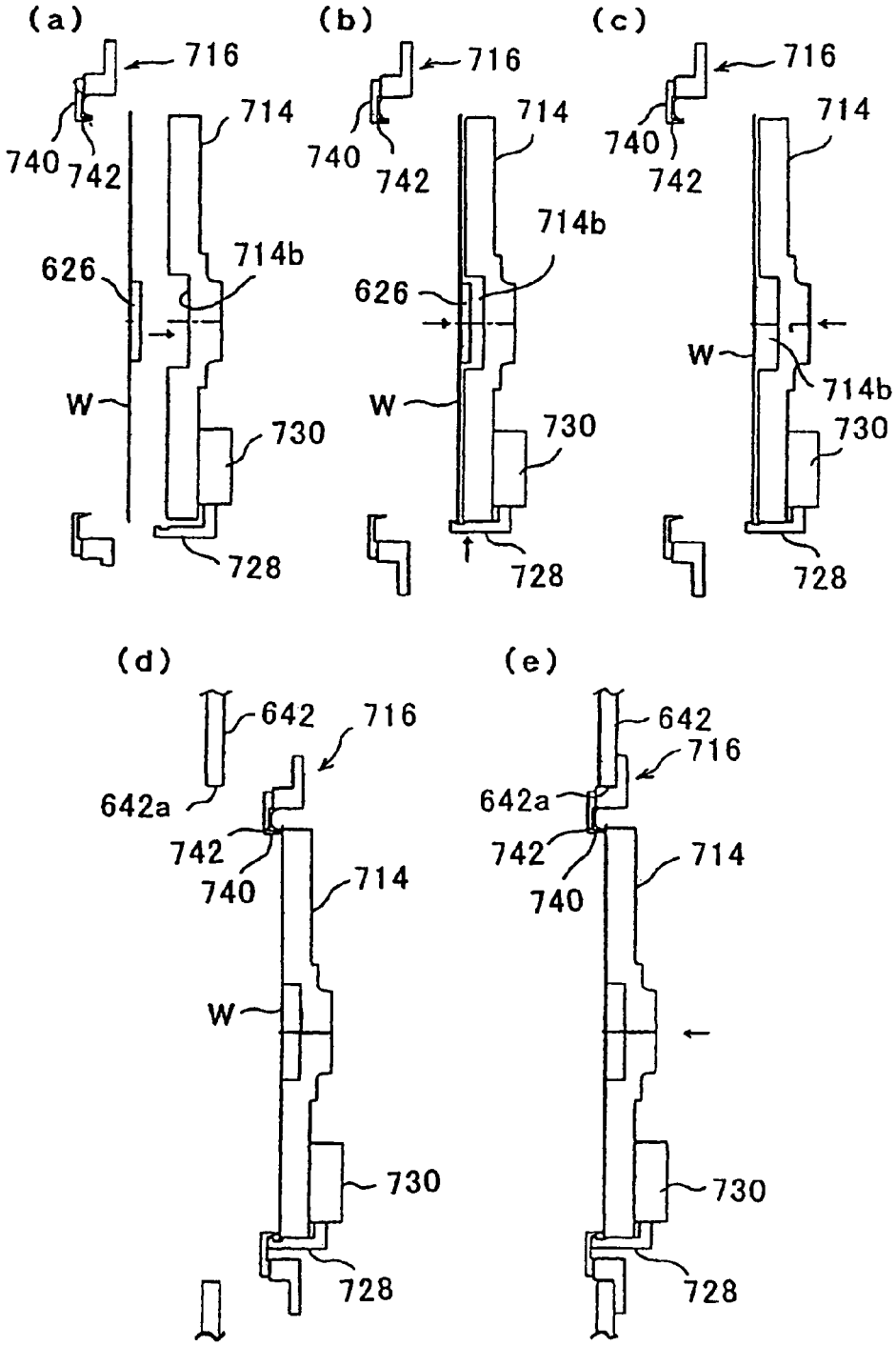
FIGS. 24(*a*) to 24(*e*) are schematic views showing the process of holding a substrate with a substrate holder.
Figure 25:
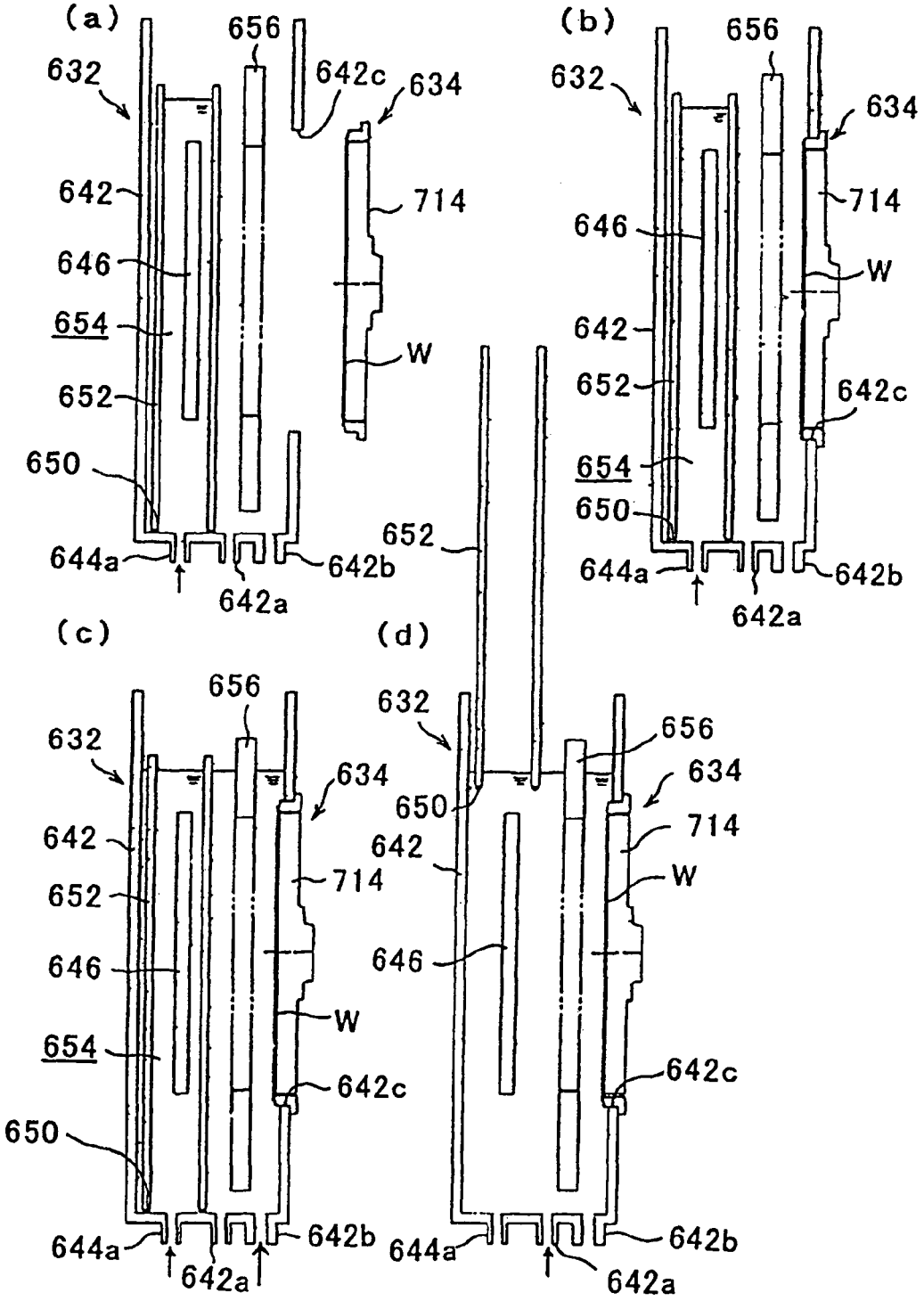
FIGS. 25(*a*) to 25(*d*) are schematic views showing the process of preparing for plating a substrate while blocking an opening of a substrate plating vessel.
Figure 26:
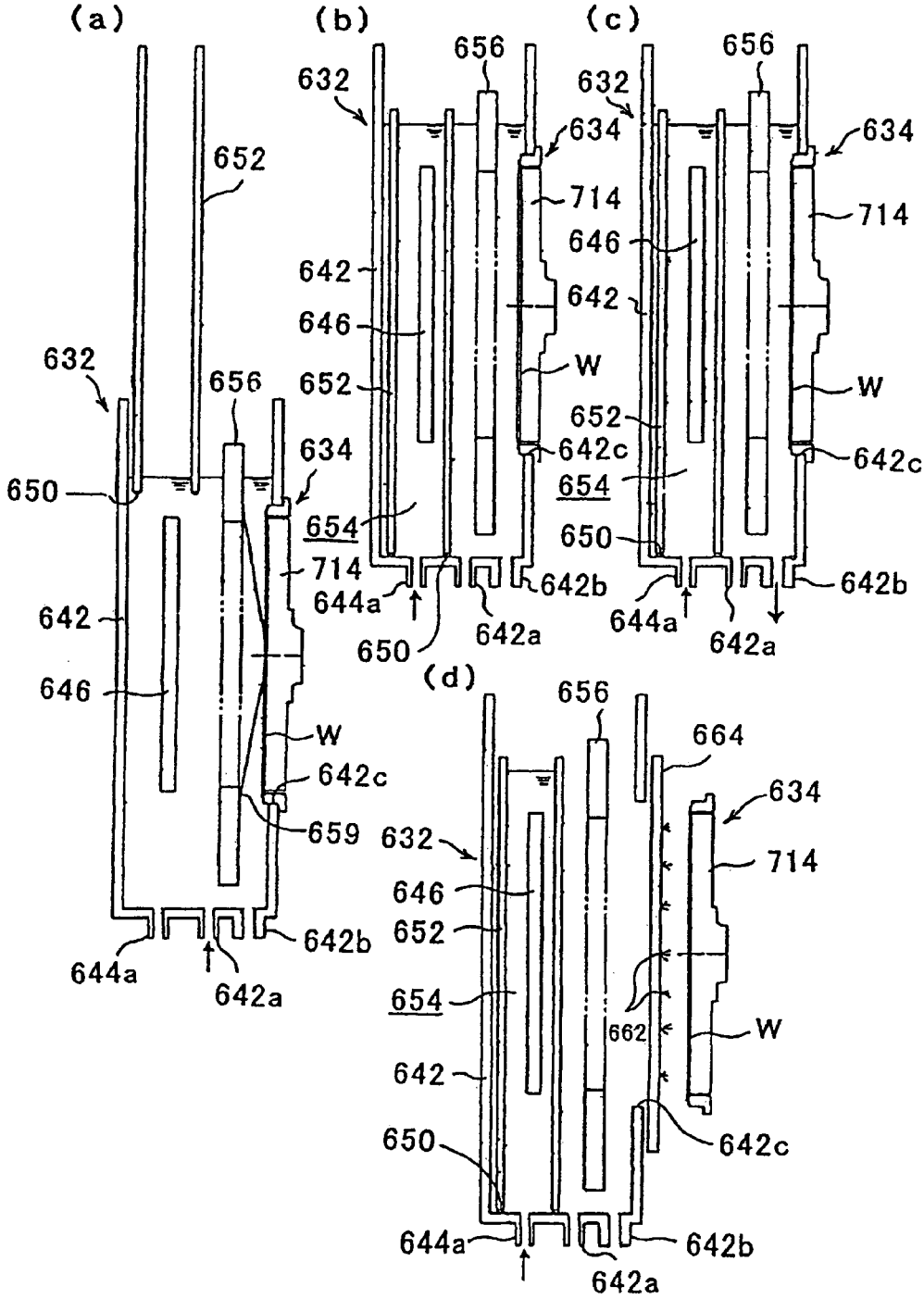
FIGS. 26(*a*) to 26(*d*) are schematic views showing the process of plating a substrate while blocking an opening of a substrate plating vessel.

Next, a series of operations are explained in which the substrate holder 634 holds the substrate W and the substrate holder 634 then water-tightly seals the aperture 642*c* of the vessel body 642 of the plating vessel 632 for plating the substrate W by referring to FIGS. 24 to 26.

Figure 17:
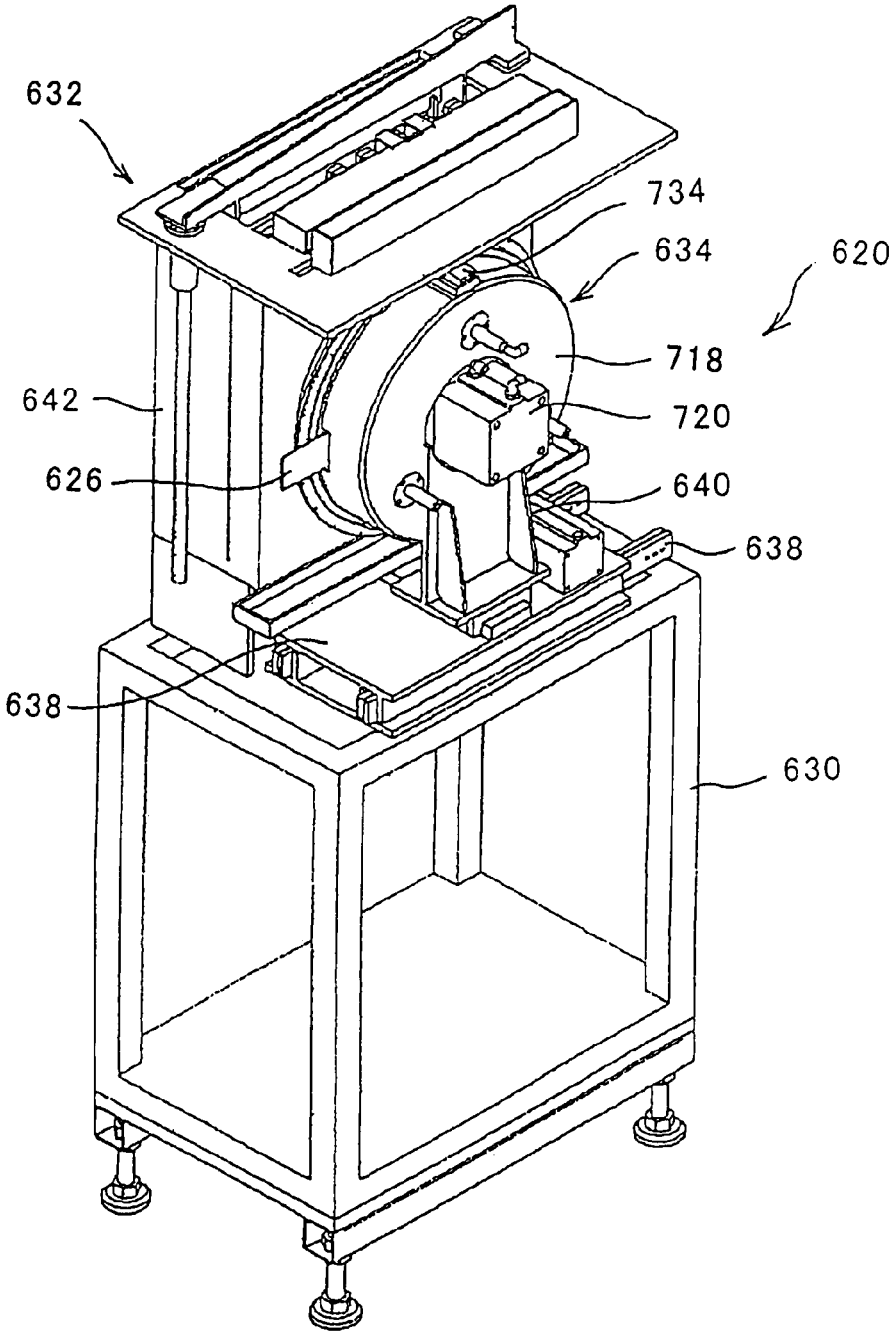
FIG. 17 is a schematic view showing a plating unit when a substrate is inserted in the substrate holder.

As shown in FIG. 24(*a*), the supporting head 714 of the substrate holder 634 is retracted away from the plating vessel 632, and the substrate W is transferred between the substrate holder 634 and the seal unit 716, which is held by the hand 626 of the transfer robot 622 (shown in FIG. 16) through suction force or by mechanical chucking and vertically arranged after reversing. Subsequently, the hand 626 holding the substrate W with a vacuum suction force, for example, is transferred to the supporting head 714 and brought into the recess 714*b* of the supporting head 714 to make the substrate W approach the flat surface 714*a* of the supporting head 714, as shown in FIG. 24(*b*). Then, the holder pins 728 are radially moved toward inside the supporting head 714, and the peripheral edge of the substrate W is located within the recess 714*b* to temporarily hold the substrate W. FIG. 17 shows this state. Then, the hand 626 releases the substrate W and is retracted from the substrate holder 634. After that, the cross drive cylinder 720 is actuated to move the supporting head 714 toward the plating vessel 632.

Figure 27:
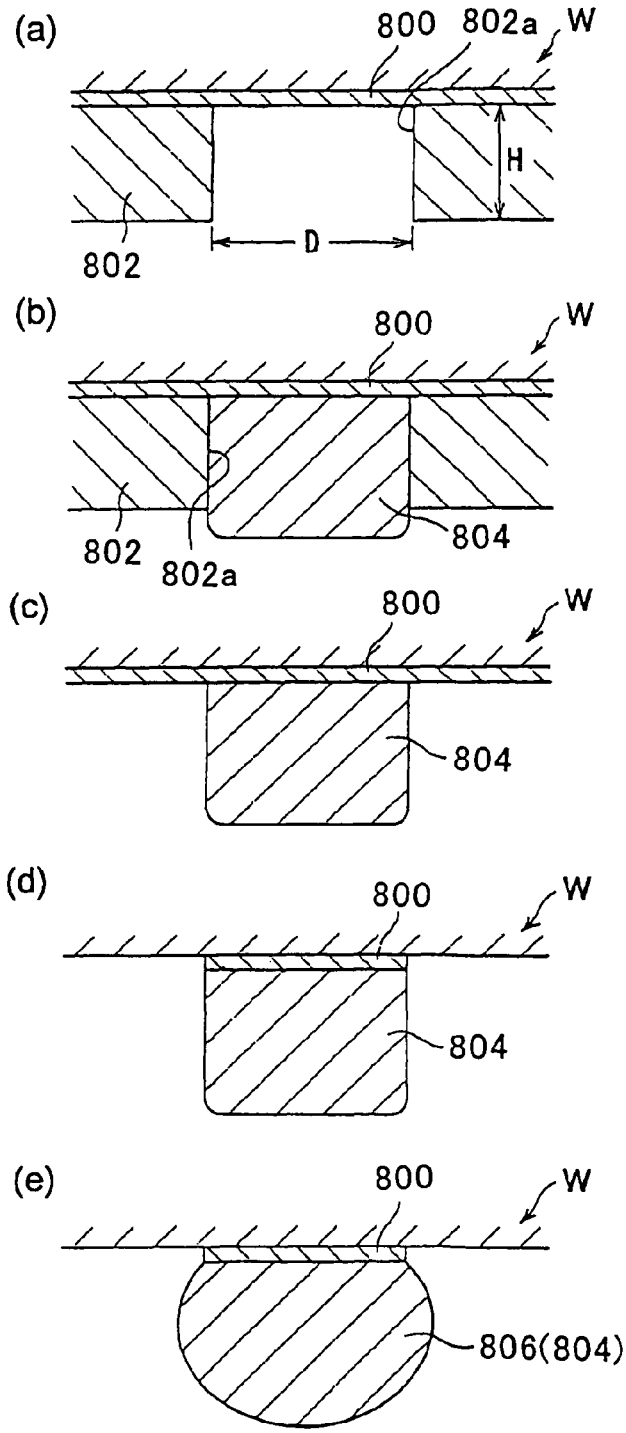
FIGS. 27(*a*) to 27(*e*) are schematic views showing the process of plating a bump on a substrate.

As the supporting head 714 moves forward, as shown in FIG. 24(*d*), the seed layer 800, as shown in FIG. 27, formed on the substrate W is contacted by the cathode electrode 742 at the periphery of the substrate W. As the supporting head 714 further moves forward, the periphery of the substrate W is pressed against the seal ring 740 to provide a water-tight seal and, concurrently, is secured through a close contact with the flat surface 714*a* of the supporting head 714.

In the plating vessel 632, as shown in FIG. 25(*a*), the weir member 652 is lowered so as to press the seal member 650 at the lower edge against the upper surface of the partition plate 644 to thereby define a reservoir chamber 654 with the weir member 652. Plating solution is introduced through the plating solution auxiliary supply system 674 to the reservoir chamber 654 and immerses the anode 646 in the plating solution within the reservoir chamber 654 before starting plating. This process prevents the anode 646 and a black film deposited on the surface of the anode 646 from drying, being oxidized, peeling off and sticking to the plating surface of the substrate W.

At the same time, the plating solution introduced to the reservoir chamber 654 and having overflowed the weir member 652 is returned to the plating solution supply tank 670 through the return line 698 so as to circulate the plating solution within the reservoir chamber 654 even when the apparatus is not in operation. By doing so, the plating solution within the reservoir chamber 654 does not suffer from variation of composition or deterioration.

To start plating, the pushing cylinder 710 is actuated to move the substrate holder 634 toward the plating vessel 632 as shown in FIG. 24(*e*), and when the projections 736*a*, 736*b* abut with the seal plate 668 (cell body 642) provided on the surface plate 669, the space defined by the projections 736*a*, 736*b* is vacuumed to provide a water-tight seal to the aperture 642*c* of the vessel body 642. In this state, the substrate holder 634 is continuously pressed at a constant pressure against the vessel body 642 with the pushing cylinder 710. The state of the plating vessel 632 is shown in FIG. 25(*b*).

Figure 18:
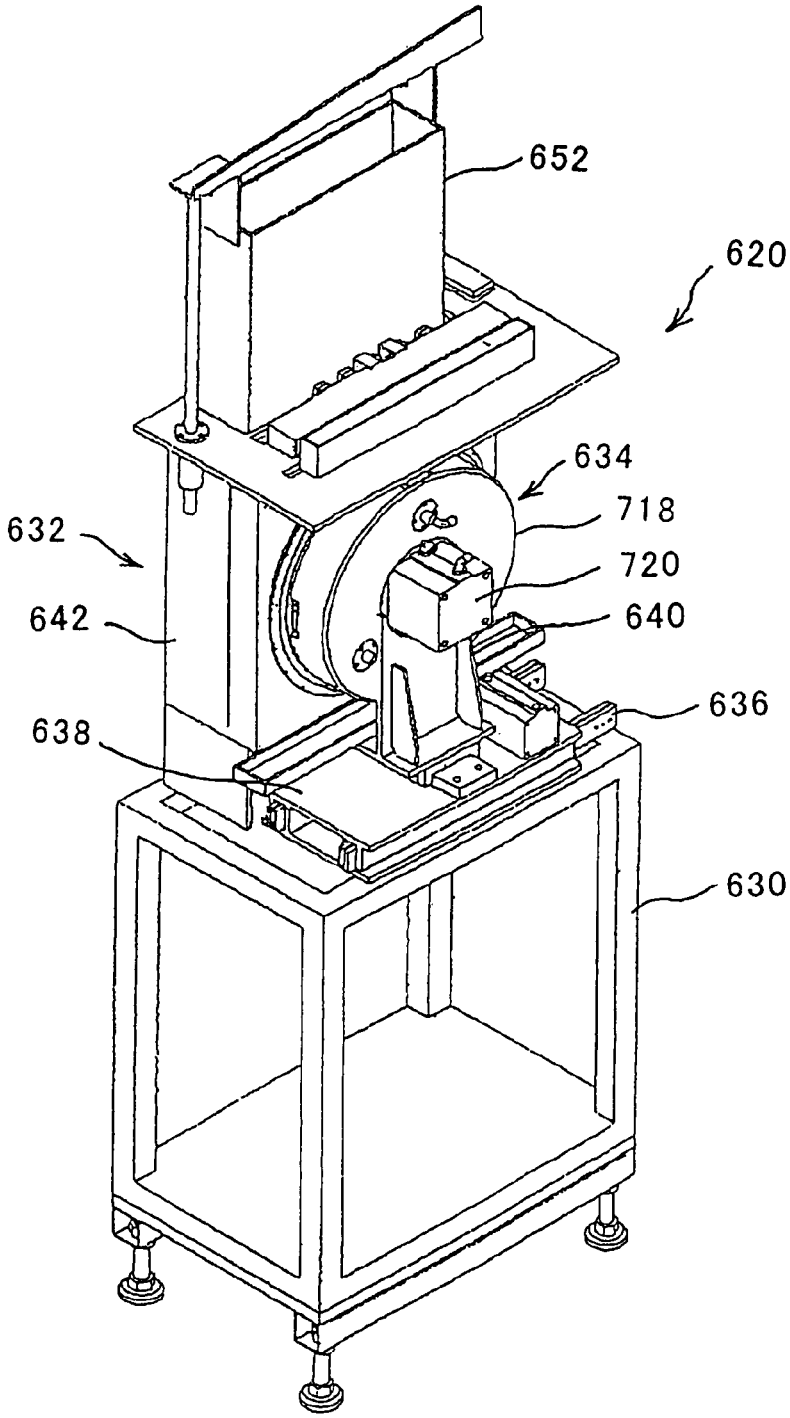
FIG. 18 is a schematic view showing a plating unit when it is plating a substrate.

Then, the plating solution is rapidly supplied into the vessel body 642 through the rapid supply line 692 of the plating solution supply system 672 as shown in FIG. 25(*c*). When a certain amount of the plating solution is introduced to the vessel body 642, the weir member 652 is lifted as shown in FIG. 25(*d*), and the anode 646 is confronted by the surface of the substrate W held in the substrate holder 634. Here, the plating power source applies plating voltage between the anode 646 and the cathode 742 which conducts to the seed layer 800 (see FIG. 27), and the predetermined amount of plating solution is supplied to the interior of the vessel body 642 through the plating solution supply system 672. Meanwhile, as shown in FIG. 26(*a*), plating solution is supplied to the nozzles 659 provided on the regulation plate 656 through the branch line 690 so as to eject the plating solution toward the substrate W held by the substrate holder 634, and the paddles 660 (see FIG. 21) are reciprocatingly moved parallel to the substrate surface. The plating solution having overflowed to the overflow vessel 643 is returned to the plating solution supply tank 670 through the return line 680 for circulation to thereby plate the substrate surface. The state here is shown in FIG. 18.

When the plating is finished, the application of the plating voltage is stopped, and the supply of the plating solution is ceased, the weir member 652 is lowered as shown in FIG. 26(*b*), and the plating solution is introduced into the reservoir chamber 654 confined by the weir member 652 through the auxiliary supply system.

Then, the plating solution within the vessel body 642 except within the reservoir chamber 654 is rapidly drained through the rapid drain line 694 by opening the shutter valve 686*d*, as shown in FIG. 26(*c*). This rapid drainage decreases the waiting time necessary for transition to a following plating process.

Then, the pushing cylinder 710 is reversely actuated to move the substrate holder 634 away from the plating vessel 632, the nozzle head 664 is moved from the retracted position and parallel to the surface of the substrate W held by the substrate holder 634, and cleaning liquid such as deionized water is ejected from the nozzles toward the substrate surface to rinse off the plating solution remaining on the substrate W. The deionized water is removed by blowing inert gas such as $N_2$ gas. Then, the plated substrate W is delivered to the hand 626 of the transfer robot 622 by reversely performing the processes described above.

Figure 19:
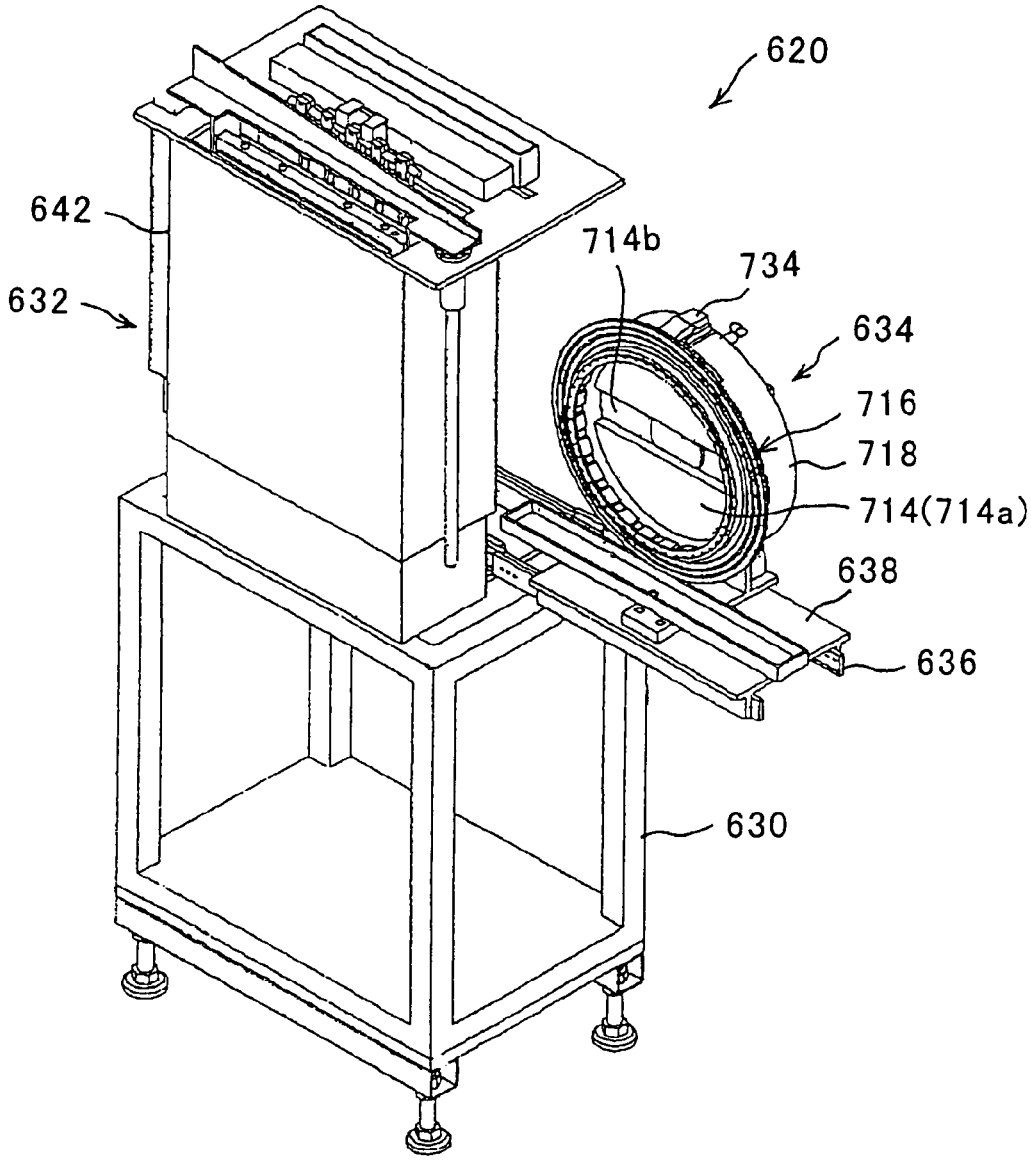
FIG. 19 is a schematic rear view showing a plating unit during maintenance.
Figure 20:
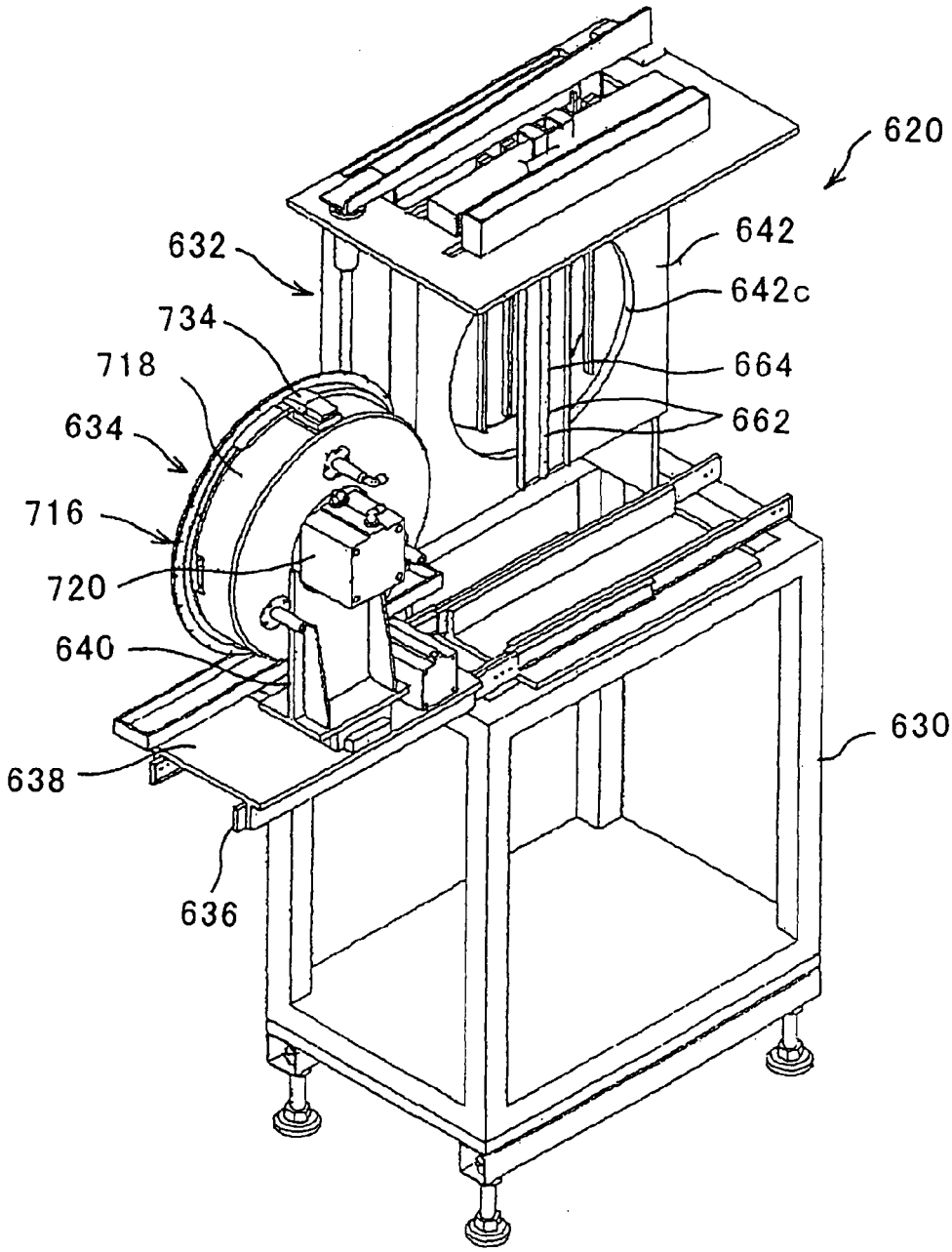
FIG. 20 is a schematic front view showing a plating unit during maintenance.

FIGS. 19 and 20 show a state where the substrate holder 634 is subjected to maintenance. During maintenance, the substrate holder 634 is slid together with the slide plate 638 along the rail 712 to a lateral position of the plating vessel 632, so that the space necessary for the maintenance is reserved to facilitate operations such as exchanging the seal unit 716 or maintaining the substrate holder 634.

Next, sequential processes of bump plating using the above plating apparatus are described. Substrates W are prepared, as shown in FIG. 27(*a*), by depositing a seed layer 800 as a feeder on the surface of the substrate W, and, after coating a resist film 802 having a thickness H of 20~120 μm on the whole surface, forming apertures having a diameter D of 20~200 μm. Substrates W are stored in the cassette so as to face the surface to be plated upward, and the cassette is then mounted on the cassette table 610.

Subsequently, the first transfer robot 616 takes one substrate W out of the cassette mounted on the table 610 and puts it on the aligner 612 to align the orientation flat or notch to a predetermined direction. The second transfer robot 622 takes the aligned substrate W from the aligner 612 and tilts the substrate W 90 degrees from a horizontal position to a vertical position with the reversing assembly 624 and delivers the substrate W to a substrate holder 634 of one of the plating units 620. Then, the substrate W held by the substrate holder 634 is plated, washed by deionized water, air-blown, and is delivered to the second transfer robot 622. The second transfer robot 622 tilts the substrate W 90 degrees from a vertical position to a horizontal position and transfers the substrate W to the rinser-dryer 614 to place it.

The rinser-dryer 614 rinses and dewaters the substrate W and returns it to the cassette loaded on the table 610 to finish the operation. Thus, the substrate W is formed with a deposited film 804 developed within the aperture 802*a* of the resist film 802, as shown in FIG. 27(*b*).

The spin-dried substrates W are immersed into a solvent such as acetone held at a temperature of 50~60° C. to remove resist films 802 formed on the substrate W as shown in FIG. 27(*c*). The substrate W is further subjected to a process for removing the exposed and unnecessary seed layer 800 as shown in FIG. 27(*d*). Then, the plated film 804 is reflowed to form a bump 806 which has been rounded by surface tension, as shown in FIG. 27(*e*). The substrate W is annealed at a temperature higher than 100° C. to remove residual stress within the bump 806.

What is claimed is:

1. An apparatus for plating a substrate having a plating surface to be plated, said apparatus comprising:

a plating vessel for accommodating a plating solution, said plating vessel having an anode therein and a lateral opening;

a substrate holder for holding the substrate while exposing the plating surface to the plating solution within said plating vessel and sealing the substrate to prevent infiltration of plating solution to a surface of the substrate other than the exposed plating surface; and a holder driving assembly for driving said substrate holder to a position where said plating surface covers said opening of said plating vessel;

wherein said plating vessel comprises a vertically movable weir member movable between a lowered position in which said weir member forms a reservoir surrounding said anode within said plating vessel, which reservoir can contain plating solution therein to immerse said anode in the plating solution, and a raised position.

2. The apparatus of claim 1, wherein said substrate holder is laterally slidable.

3. The apparatus of claim 1, further comprising an auxiliary plating solution supply system for circulating said plating solution within said reservoir.

4. The apparatus of claim 1, further comprising a drain system for draining plating solution from said plating vessel.

5. The apparatus of claim 1, further comprising a nozzle for ejecting plating solution toward said plating surface of said substrate held by said substrate holder.

6. The apparatus of claim 1, wherein said substrate holder comprises a detachable seal unit comprising a seal ring and a cathode integrated together.

7. The apparatus of claim 6, wherein said seal unit comprises a seal member for water-tightly sealing said opening of said plating vessel.

8. The apparatus of claim 1, wherein in said raised position said weir member is at a position so that said anode faces the substrate surface without intervention of said weir member.

9. A method of plating a substrate having a plating surface to be plated, said method comprising:

accommodating an anode in a plating vessel having a lateral opening;

holding said substrate with a substrate holder and sealing said substrate to prevent infiltration of plating solution to a surface of said substrate other than said plating surface;

driving said substrate holder to a position where said plating surface covers said opening of said plating vessel;

forming a reservoir surrounding said anode within said plating vessel with a weir member and immersing said anode by introducing plating solution into said reservoir;

sealing said opening of said plating vessel and then introducing said plating solution into said plating vessel except within said reservoir to expose said plating surface to said plating solution; and raising said weir member and then applying a plating voltage.

10. The method of claim 9, further comprising draining plating solution from said plating vessel except from within said reservoir after plating is finished.

11. The method of claim 10, wherein said weir member is lowered to again form said reservoir before said draining begins.

* * * * *